United States Patent [19]

Tanaka et al.

[11] Patent Number: 4,622,916

[45] Date of Patent: Nov. 18, 1986

[54] COLOR IMAGE FORMING APPARATUS

[75] Inventors: Kiyoharu Tanaka, Yokohama; Akio Ohno; Yasushi Murayama, both of Tokyo; Osamu Hoshino; Yusaku Takada, both of Tokyo, all of Japan

[73] Assignee: Canon Kabushiki Kaisha, Tokyo, Japan

[21] Appl. No.: 781,532

[22] Filed: Sep. 30, 1985

[30] Foreign Application Priority Data

| | | | |
|---|---|---|---|
| Oct. 18, 1984 | [JP] | Japan | 59-217418 |
| Nov. 5, 1984 | [JP] | Japan | 59-231213 |
| Nov. 7, 1984 | [JP] | Japan | 59-233065 |
| Nov. 13, 1984 | [JP] | Japan | 59-238845 |

[51] Int. Cl.[4] ..... B05C 11/00

[52] U.S. Cl. ..... 118/688; 118/645

[58] Field of Search ..... 118/645, 688

[56] References Cited

U.S. PATENT DOCUMENTS

| | | | |
|---|---|---|---|
| 3,709,594 | 1/1973 | Hastwell | 355/4 |
| 3,987,756 | 10/1976 | Katayama et al. | 355/4 |
| 4,063,724 | 12/1977 | Suda | 271/277 |

*Primary Examiner*—Bernard D. Pianalto

*Attorney, Agent, or Firm*—Fitzpatrick, Cella, Harper & Scinto

[57] ABSTRACT

A toner supplying system for use in combination with a developing device (100) of the type having a conveyor means (300) carrying a plurality of developing units (101) such as to bring the desired developing unit to the developing position for the development of a latent image on an image carrying member (1). The toner supplying system comprises a hopper (201) disposed outside the developing device, a shaft (310) provided in the toner conveyor means, a toner transportation means (202) for transporting the toner from the hopper to the shaft, and a toner passage means (310, 350) through which the toner is supplied from the shaft to respective developing units. The toner passage means includes annular chambers (351) formed between the hollow shaft (310) and an intermediate pipe (350). The annular chambers are separated axially by partition sealing means (354). Toner passage means (225, 450), switchable between open and shut-off states and adapted to take the open state only when their associated developing unit is in a toner supplying position, are also provided. The system further comprises a toner density detecting means (50) for detecting the toner density in the developing agent on the developing unit under development. The toner density detecting means produces, when the detected toner density is too low, a signal for bringing the developing unit to the toner supplying position after completion of the development of the final color on a copying paper under developing operation.

69 Claims, 25 Drawing Figures

COLOR IMAGE FORMING APPARATUS

BACKGROUND OF THE INVENTION

1. Field of the Invention

The present invention relates to developing devices and more specifically to a system (referred to herein as "toner supplying device") for supplying a developing agent or toner to a developing device in a color printing system, for example, the developing device of a computer or facsimile printer or the developing device of an electrophotographic color copying machine. More particularly, the invention is concerned with a toner supplying system suitable for use in a developing device which has a plurality of developing units carried by a conveyor device adapted for conveying each developing unit successively to a latent image carrying member thereby allowing a latent image thereon to be developed.

The toner supplying system of the invention can be used not only for a rotary developing device of the type having a rotary conveyor for carrying several developing units along a circular path but it can also be used for a developing device having a different type of conveyor device such as an endless belt adapted to convey the developing units along, for example, a non-circular path, such as an oval path.

It is to be noted also that the toner supplying system of this invention is useful in both dry and wet types of developing apparatus, and for the supplying of both bi-component developing agents which contain a carrier and a toner and mono-component developing agents which comprise only a magnetic toner.

Furthermore, when the toner supplying system of the present invention is used with the developing apparatus of a color electrophotographic copying machine or a color recording device, the developing apparatus may be either a full-color or a multi-color type apparatus which employs two, three or more individual colors. It is to be understood also that the invention can be carried out successfully not only with an electrophotographic sensitive device but also with various other types of latent image carrying members such as an insulating member carrying a latent image.

2. Description of the Prior Art

In recent years, there has been a rapidly increasing demand for color copying, not only in certain specialized fields but also in the clerical field in general. This in turn has given rise to a demand for color copying machines which can be handled easily by persons who do not have any specific skill in the copying machine field as well as by professionals. Under these circumstances, and in order to meet this demand, copying machines generally referred to as a "full-color electrophotographic copying machines", which make use of electrophotographic techniques, have become widely used.

The prior art full-color electrophotographic copying machines still suffer, however, from various problems or shortcomings which need to be overcome or improved. One of these problems resides in the fact that it is quite difficult to supply toners or developing agents of different colors to respective developing units of the developing apparatus. These toners or developing agents make visible the electrostatic latent image of the different colors formed on the photosensitive member of the machine.

Various developing devices proposed and used hitherto for color electrophotography may be broadly classified in either of two types. The first type, which is generally referred to as a "side-by-side" type developing device, has a plurality of developing units containing developing agents of different colors and arranged in a side-by-side fashion along the surface of the photosensitive member. This type of developing device is the most popular at the present time. In an ordinary commercially available electrophotographic copying machine, the photosensitive member has the form of a cylindrical drum; and the developing units of the developing device are disposed in side-by-side fashion circumferentially of the peripheral surface of the photosensitive drum.

The second type of developing device is generally referred to as a "rotary" type developing device in which, as disclosed in Japanese Patent laid-Open No. 131/1972 (corresponding to U.S. Pat. No. 3,709,594), and in Japanese Patent Laid-Open No. 93437/1975, a plurality of developing units are arranged around a rotary wheel which is disposed in the vicinity of the photosensitive member. The developing units disclosed in the former of those patents use liquid type developers U.S. Pat. No. 3,987,756 discloses a dry powder developing device of the rotary type wherein a plurality of developing units are supported by a supporting member; and development with a desired color is effected by rotation of the supporting member. Also, U.S. Pat. No. 4,063,724 discloses a developing device wherein a plurality of developing units are juxtaposed along a circumferential surface of a photosensitive member.

Side-by-side type developing devices require a complicated form of construction and control. More specifically, in this type of device, it is essential for the developing units other than the operating one to be kept inoperative. This requires suitable control of the rotation of magnetic brushes in respective developing units or under arrangement to keep the inoperative developing units away from the surface of the photosensitive drum.

Another problem encountered by side-by-side type developer devices is that the diameter of the photosensitive drum inevitably needs to be increased in order to allow all the developing units to be arranged around and in the vicinity of the photosensitive drum. This makes it difficult to miniaturize the electrophotographic copying machine as a whole.

Still another problem resides in the fact that a suitable means is required to compensate for the time decay of the latent image on the photosensitive surface. This time decay is different for each of the colors because the distance between the location on the photosensitive surface where the latent image is applied and the location of each of the developing units is different. Hence, the time duration until the development of the latent image in each color varys according to the color. Compensation for this is extremely difficult to carry out and makes it difficult to adequately control the developing device and the copying machine as a whole.

In contrast, the rotary type developing device in which only the developing unit of the desired color is brought to the position near the photosensitive drum, allows a reduction in the size of the photosensitive drum and, therefore, the size of the color electrophotographic copying machine as a whole. At the same time, the rotary type developing device eliminates the necessity for compensation for time decay of the image of each color.

As is known to those skilled in the art, a developing device of the type known as a "magnet brush type" developing device makes use of a bi-component developing agent which is composed of a toner and a magnetic powder serving as a carrier. This type of developing device usually has a developing chamber which contains the developing agent. There is also provided a toner chamber for storing only the toner. When the density of the toner in the developing agent contained in the developing chamber decreases below a predetermined level, additional toner is supplied from the toner chamber to the developing chamber to reinstate the desired density. In order to store a large quantity of toner, the toner chamber is preferably large in size. The use of a large toner chamber naturally increases the size and weight of the developing device as a whole. It is quite difficult and, in normal practice impossible, to drive and control such a large and heavy developing device which has a large moment of inertia.

For this reason, hitherto, the toner chamber has been designed to be small in size and a cartridge type toner charging device has been used to charge the toner chamber with the toner as desired.

The use of small toner cartridges, however, is disadvantageous in that frequent charging of toner is required, particularly when a large number of copies is to be made. This in turn requires frequent stopping of the developing device and driving of the developing unit to the toner charging position; and it involves a laborious job of inserting the toner charging device into the developing unit so as to charge the toner chamber with the toner. Consequently, the operator is burdened by troublesome work and copying efficiency is seriously impaired.

It is to be noted also that the conventional toner supplying system explained above cannot perfectly avoid external scattering of the toner from the toner supplying device.

In addition, the developing unit of the above described prior art developing machines has to be designed such as to enable the toner charging device to be detachably attached thereto. Such a design makes it difficult to provide a developing unit of hermetic construction; and it is therefore possible that the toner or the developing agent will become scattered into the copying machine during the operation of the developing device or when the developing unit is subjected to vibration or impact at the time of starting or stopping of the developing unit. The scattered toner or developing agent not only contaminates the copying machine and the operator but also impairs the quality of the copy image due to mixing of developing agents of different colors.

These problems are encountered also by developing devices designed to be supplied with the developing agent.

SUMMARY OF THE INVENTION

It is one object of this invention to provide in a developing device a toner supplying system which is improved such as to permit storage of a large quantity of toner while reducing the size of each developing unit and, accordingly, the overall size of the developing device, while allowing continuous production of a large number of copies.

It is another object of the invention to provide a toner supplying system which allows the size and, hence, the inertia of the developing device to be reduced so as to facilitate the driving and control of the movable developing device.

It is still another object of the invention to provide an improved toner supplying system which avoids scattering of toner particles and thereby prevents contamination of the copying machine and the operator, and at the same time ensures higher quality of the copy image by preventing mixing of developing agents of different colors.

According to one aspect of the invention there is provided, in combination, a novel developing device of the type in which a developing unit conveyor carries a plurality of developing units along a continuous path so that each developing unit is successively brought to a developing position for the development of a latent image on an image carrying member; and a novel toner supplying system comprising hopper means mounted apart from the developing unit conveyor and toner conveyor means extending from the hopper means to a predetermined filling position of each of the developing units along the continuous path.

According to another aspect of the present invention there is provided, in combination, a developing device of the type in which a conveyor carries a plurality of developing units around a circular path so that each developing unit is successively brought to a developing position for the development of a latent image on an image carrying member; and a novel toner supplying system comprising a hollow shaft extending along the axis of the circular path of the developer units. Toner conveyor means are arranged to supply toner into the interior of the hollow shaft and passage means are provided to extend through the side of the shaft between the interior thereof and the developing units.

According to one preferred form of the invention, there is provided a pipe connected between a hopper and a toner passage means located in a hollow shaft around which the developing units move. A screw is positioned to turn in the pipe, and an electric motor is coupled for driving the screw.

According to another form of the invention, there is provided a developing unit conveyor which includes a rotor rotatably supported by a hollow shaft. The toner passage means for each developing unit is constructed to be opened when the respective developing unit is located at a predetermined toner supplying position. The toner is moved through the toner passage means and into each developing unit by the force of gravity.

The present inventors have also proposed a toner supplying system for a rotary type developing device wherein the rotary developing device is driven around a hollow rotary supporting shaft and a pipe leading from an external toner container (referred to herein simply as "hopper"), extends through the hollow rotary supporting shaft. The pipe has a screw-type feeder disposed therein, so that the toner is fed from the hopper to the developing unit as the screw-type feeder rotates. This toner supplying system minimizes the scattering of the toner because it can be substantially hermetically constructed.

In order to completely prevent any leakage of the toner, it is necessary to maximize the sealing effect in the toner supplying system in an efficient way. To this end, it is necessary to minimize the gap between the parts constituting the toner supplying system. A too small gap, however, imposes a new problem in that any toner particle caught in the gap between a stationary part and a movable part would impair the smooth movement of the movable part and, in some cases, the movable part could be prevented from moving at all. In particular, when a portion of the toner supplying system is formed between the stationary hollow supporting shaft and a rotor which supports the developing unit, the driving load for driving the rotor is increased and, in the worst case, the rotor is locked against movement.

Accordingly, in a still further aspect, the present invention provides a novel toner supplying system comprising a toner passage means for supplying toners of different colors to respective developing units from an external hopper means. In this aspect the toner passage means includes a shaft extending through the conveyor means and an annular chamber surrounding the shaft. In a preferred form, the shaft is hollow and the conveyor means for the developer units includes a rotor which rotates about the hollow shaft. The annular chamber is defined between the hollow shaft and an intermediate pipe which surrounds the hollow shaft and rotates together with the conveyor means about the hollow shaft. The annular chamber is sectioned by sealing members which partition the chamber into a plurality of annular sub-chambers. The hollow shaft and the intermediate pipe are provided with supply ports and relay ports which communicate with the annular sub-chambers. Preferably, the annular sub-chambers are arranged in the axial direction of the hollow shaft and the intermediate pipe. Also, in a preferred arrangement, the intermediate pipe is composed of a plurality of pipe segments.

Thus it is a further object of the invention to provide a toner supplying device which is improved such as to avoid scattering of toner particles, thereby preventing contamination of the copying machine and the operator while ensuring high quality of the copy image through elimination of mixing of developing agents of different colors.

In a preferred form of the invention, there is provided partition sealing means which includes a pair of partitioning members and a spring means which urges the partitioning members towards each other such as to keep them in contact with each other. In another form, the partitioning sealing means includes a first partitioning member fixed to the outer surface of the hollow shaft, a second partition member provided on a wall concentric with and facing the shaft and making a sliding contact with the inner peripheral surface of the first partitioning member. Pressure contact members are provided to contact both side surfaces of at least one of the first and second partitioning members, and spring means are arranged to urge the pressure contact members towards the partitioning member. In a still further form, the partitioning sealing means includes an elastic ring secured to a concentric wall and held in resilient contact with the outer peripheral surface of the hollow shaft for sliding movement relative to the shaft.

According to a further aspect of the invention, there is provided a toner supplying system for use in combination with a developing device of the type having a conveyor means carrying a plurality of developing units such as to bring each developing unit successively to a predetermined developing position for the development of a latent image on an image carrying member. The toner supplying system comprises hopper means disposed externally of the developing device and toner passage means connecting the hopper means to the developing device. The toner passage means is switchable between open and shut-off or closed states and is adapted to assume the open state only when one of developing units of the developing device is in a toner supplying position.

This last mentioned aspect of the invention is particularly advantageous in connection with rotary type developing devices having a rotor detachably carrying a plurality of developing units so as to bring each developing unit to a developing position, wherein the orientation of a toner receiving formed in each developing unit is changed as a result of rotation of the rotor. In such developing devices, the developing agent or the toner is allowed to flow out of the developing unit through the toner receiving port when the latter is directed downwardly; and this could result in scattering of the developing agent or toner, unless a suitable countermeasure is taken. The toner scattered outside the developing device would not only contaminate the inside of the copying machine but would also cause various detrimental effects on the constituents of the copying machine. In addition, the scattering of the toner and developing agent would also cause a change in the toner to carrier ratio of the developing agent, thus impairing the quality of the product image. These problems are overcome by virtue of this last mentioned aspect of the invention.

In one preferred arrangement, the toner passage means includes toner receiving ports formed in the developing units and shutter plates for opening and closing the toner receiving ports. The shutter plates are swingable about respective pivot axes by the force of gravity.

In another preferred arrangement, the toner passage means includes shielding means slidably attached to the hollow shaft such as to open and close toner supplying ports formed in the hollow shaft to which a toner transporting means is connected. The shielding means normally closes the toner supplying ports. Also, toner receiving ports are formed in the developing units; and shutter means are slidably attached to the developing units so as to open and close the toner receiving ports. The shutter means normally close the toner receiving ports. The shutter means are adapted to engage the shielding means when the associated developing unit is moved to the predetermined toner supplying position such that the shutter means and the shielding means are moved together thereby opening the toner receiving port and the toner supplying port.

According to another aspect of the invention, hopper means are supported rotatably in such a manner as to correspond to the developing device. Also, the toner passage means includes toner supplying ports formed in respective hoppers of the hopper means and shutter means slidably attached to respective hoppers such as to open and close the toner supplying ports. The shutter means normally closes the supplying ports. Toner receiving ports are formed in respective developing units of the developing device. A shutter means is slidably attached to each of the respective developing units such as to open and close the toner receiving ports. The shutter means normally closes the toner receiving ports and plunger means were arranged for operating the shutter means for the hoppers and the shutter means for the developing units. Accordingly, when a selected developing unit and the associated hopper are moved to a toner supplying position, both shutter means are operated by the plunger means such as to open both the toner supplying port and the toner receiving port.

The above and other objects, features and advantages of the invention will become clear from the following description of the preferred embodiments when the same is read in conjunction with the accompanying drawings.

DESCRIPTION OF THE PREFERRED EMBODIMENTS

Figure 1:
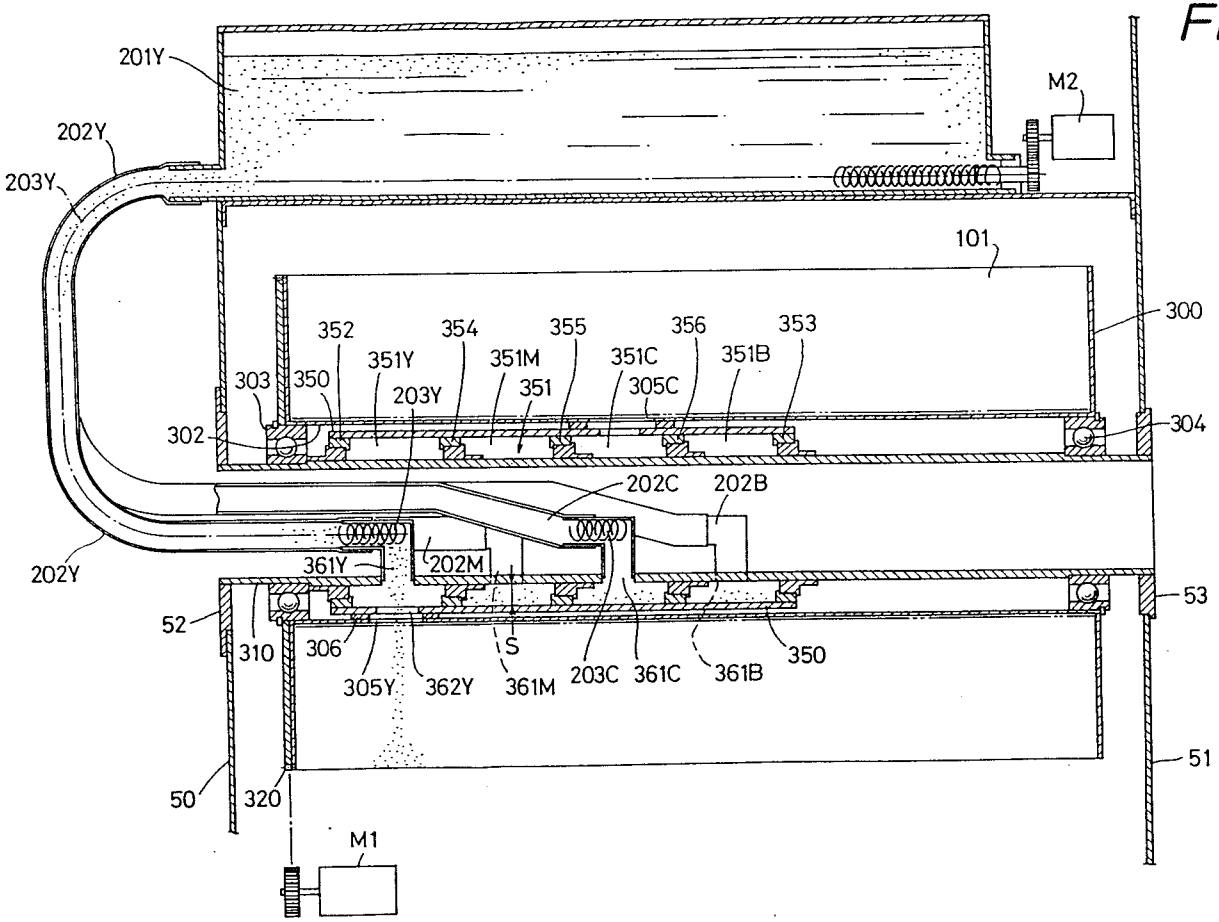
FIG. 1 is a section view of one embodiment of a toner supplying system in accordance with this invention.

Preferred embodiments of the toner supplying system of the invention are explained herein with reference to the accompanying drawings. Although the embodiments are described in connection with dry rotary type developing devices for a full-color type electrophotographic copying machine, it is to be understood that the invention can be equally well applied to other types of developing devices as stated above.

Various processes for forming electrostatic latent images are available for full-color electrophotography. These include the "NP process" which involves the steps of primary charging, secondary charging/color separation exposure and overall exposure. These processes also include the "Carlson" process which involves the steps of primary charging and color separation exposure. Other processes are also available. An electrophotographic copying machine which uses the Carlson process will be referred to specifically in the following description by way of example.

First of all, an explanation will be made as to the general arrangement of a full-color electrophotographic copying machine to which the toner supplying system of the invention is applied, with specific reference to FIG. 2 which is a schematic sectional view of a full-color electrophotographic copying machine. This copying machine has a photosensitive drum 1 disposed substantially at the center of the machine and provided with an electrophotographic photosensitive layer formed on the surface thereof. The photosensitive drum 1 is adapted to be rotated about a horizontal axis in the direction of the arrow X, i.e., counter-clockwise as viewed in FIG. 2.

The copying machine further has a primary charger 2 disposed substantially directly above the photosensitive drum 1. A rotary developing device 100 is disposed on the left of the photosensitive drum 1 as viewed in FIG. 2. This rotary developing device incorporates a toner supplying system 200 according to the invention, a transfer device 5 disposed substantially directly below the photosensitive drum 1, and a cleaning device 6 disposed to the right of the photosensitive drum 1 as viewed in FIG. 2. The transfer device 5 rotates in the direction of the arrow A, i.e., clockwise as viewed in FIG. 2.

An optical system 10 is disposed above the electrophotographic copying machine and is adapted to project the image of an original O on a platen 7 onto the portion of the photosensitive drum 1 which lies in an exposure section 3 defined between the primary charger 2 and the rotary developing device 100. Any suitable optical system can be used as the optical means 10. In the described embodiment, the optical system 10 includes a first scanning mirror 11, second and third scanning mirrors 12 and 13 adapted to move in the same direction as the movement of the first scanning mirror at a speed which is half that of the movement of the first scanning mirror 11, an image forming lens 14, and a fourth mirror 15 which is stationary. This type of optical system is well known to those skilled in the art as the "slit-type exposure optical system" and, therefore, no further explanation of this optical system is needed herein. An original illuminating light source 16 is designed for movement together with the first scanning mirror 11, while a color separation filter 17 is disposed between the stationary fourth mirror 15 and the exposure section 3.

Therefore, during the scanning operation, light reflected by the original O is reflected by the first, second and third scanning mirrors 11, 12 and 13 and is transmitted through the lens 14. Then, after being reflected by the stationary fourth mirror 15, the light is color-separated by the color-separation filter 17 to form a color-separated image on the portion of the photosensitive drum 1 in the exposure section 3.

Figure 2:
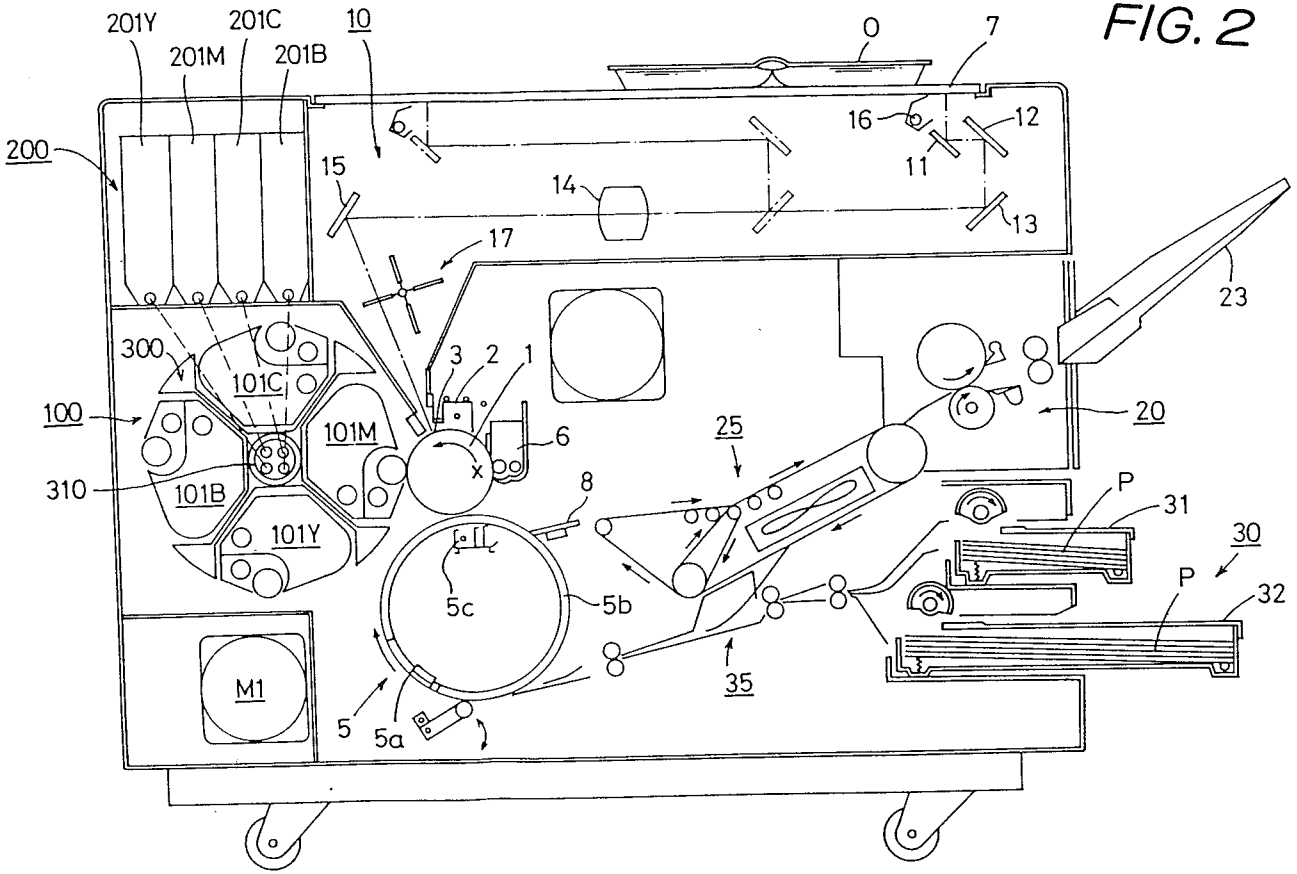
FIG. 2 is a schematic sectional view of a full-color electrophotographic copying machine incorporating the toner supplying system of the invention.

A fixing device 20 and a paper feeding device 30 are disposed on the right side of the full-color electrophotographic copying machine as viewed in FIG. 2. Transfer paper conveyor systems 25 and 35 are disposed between the transfer drum 5 and the fixing device 20 and between the transfer drum 5 and the paper feeding device 30, respectively.

In operation, a series of steps such as charging, exposure, development, transfer and cleaning are effected successively for each of the colors separated by color separation filter 17, by means of the primary charger 2, the optical system 10, the rotary developing device 100, the transfer device 5 and the cleaning device 6.

As will be detailed later, the rotary developing device 100 includes a developing unit 101Y for yellow color (referred to herein as the "yellow developing unit"), a developing unit 101M for magenta color (referred to herein as the "magenta developing unit"), a developing unit 101C for cyane color (referred to herein as the "cyane developing unit"), and a developing unit 101B for black color (referred to herein as the "black developing unit"). These developing units apply toner of different colors to the latent image on the photosensitive drum 1 for visualizing the latent image in the respective colors separated by the color separation filter.

Typically, the transfer device 5 includes a transfer drum 5*b* which is provided on the periphery thereof with a gripper 5*a* for gripping transfer paper P. The leading end of the transfer paper P, which has been fed from a cassette 31 or 32 of the paper feeding device 30 through the transfer paper conveyor system 35, is gripped by the gripper 5*a* of the transfer device 5, and is fed onto the photosensitive drum 1 so that the visualized images of respective colors are transferred to the transfer paper P. The transfer of the images takes place within a transfer region which is defined by a transfer charger 5*c* disposed inside the transfer drum 5*b*.

The transfer paper P on which the images of respective colors have been successively transferred is released from the gripper 5*a* and is separated from the transfer drum 5*b* by means of a separator claw 8, and is sent to the fixing device 20 by means of the transfer paper conveyor system 25. The toner image on the transfer paper P is fixed by the fixing device 20 and, thereafter, the transfer paper is discharged to the tray 23.

The following is an explanation of the operation of the rotary developing device 100.

Referring to FIGS. 1 and 3 to 5, the rotary developing device 100 has a plurality of developing units 101. In the illustrated case, there are four developing units: namely, a yellow developing unit 101Y, a magenta developing unit 101M, a cyane developing unit 101C and a black developing unit 101B. The developing device 100 also has a rotor 300 which detachably mounts the developing units 101Y, 101M, 101C and 101B.

Figure 3:
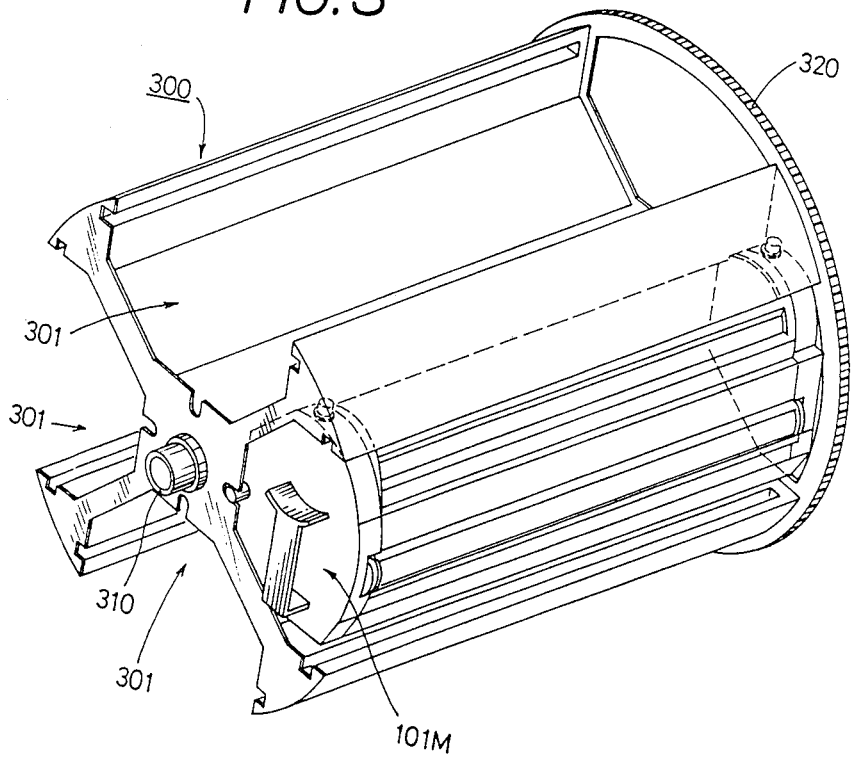
FIG. 3 is a perspective view of a rotary developing device to which the toner supplying system of the invention is applied.
Figure 4:
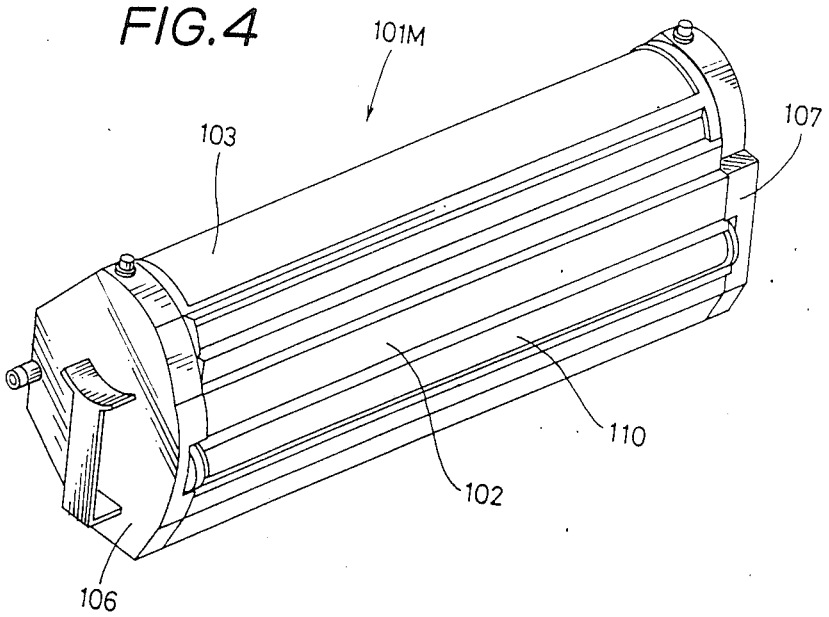
FIG. 4 is a perspective view of a developing unit incorporated in the rotary developing device shown in FIG. 3.
Figure 5:
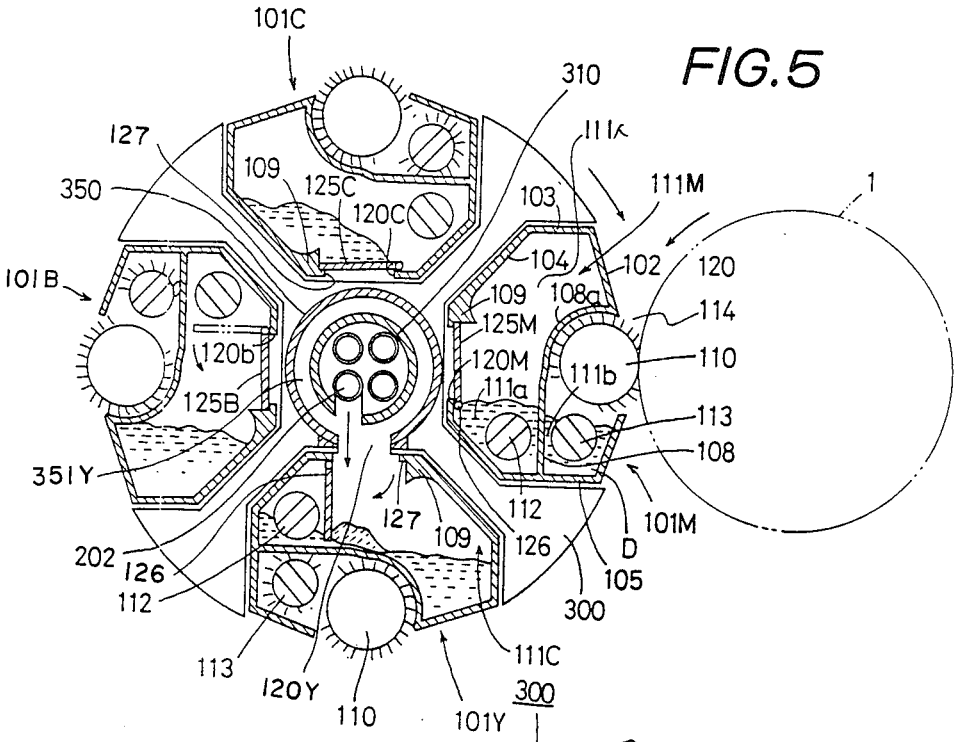
FIG. 5 is a schematic cross sectional view of the rotary developing device shown in FIG. 3.

Basically, all of the developing units 101 have identical construction and shape. FIG. 4 exemplarily shows the appearance of the magenta developing unit 101M, while FIG. 5 shows in section the developing device 100 with the four developing units 101 mounted thereon. FIG. 3 is a perspective view of the rotor 300 of the developing device 100 in which the developing units other than the magenta developing unit 101M are omitted.

The construction of the developing unit 101 will be explained hereinunder with specific reference to the magenta developing unit 101M, by way of example. As will be seen in FIG. 5, which shows the developing device 100 in section, the magenta developing unit 101M has a developing housing constituted by a front wall 102, an upper wall 103, a rear wall 105 and the side walls 106, 107 (see also FIG. 4).

As shown in FIG. 5, a developing chamber 111M in the housing of the developing unit 101M contains a developing agent D. The developing chamber 111M is sectioned by a partition wall 108 into first and second developing chambers 111*a* and 111*b* which are provided therein with stirring screws 112 and 113, respectively. Although not shown, communication ports are formed in the portion of the partition wall 108 adjacent both side walls 106 and 107. The arrangement is such that the developing agent is recirculated between the first and second developing chambers 111*a* and 111*b* by the operation of the stirring screws 112 and 113.

A developing roller 110 is disposed above the second developing chamber 111*b*. A portion of the developing roller 110 projects through a window 114 formed in the front wall 102. The developing roller 110 is composed of a magnet roller constituting the core portion and a sleeve roller surrounding the magnet roller. The sleeve roller is made of a non-magnetic material such as brass, stainless steel or the like. The magnet roller and the sleeve roller rotate in opposite directions.

The region or portion of the photosensitive drum 1 under the influence of the developing roller 110 is limited by the window 114 formed in the front wall 102 of the developing unit.

In the case where the gap between the window 114 and the developing roller 110 is directed downwardly, the developing agent is prevented from dropping off through the gap by virtue of the interaction between a magnetic field and the developing agent as explained in Japanese patent Publication No. 20579/1980 assigned to the assignee of this invention.

As will be understood from the foregoing description, the developing agent used in this embodiment is a bi-component developing agent which is composed of a toner and a carrier, the toner containing a dyestuff or a pigment dispersed in a polyester resin base, while the carrier is constituted by a magnetic powder.

A development preparatory chamber 111*c* is defined above the first developing chamber 111*a*. The development preparatory chamber 111*c* is isolated from the developing roller 110 by an upper partition wall 108*a* connected to the partition wall 108. The rear wall 104 defining the development preparatory chamber 111*c* has a toner receiving port 120M for receiving the toner supplied from the toner supplying system 200 (FIG. 2). A reverse flow prevention shutter 125 is fitted to the receiving port 120M and is adapted to be opened and closed by the force of gravity such as to prevent reverse flow of the toner. That is, the shutter 125 is connected along one edge by means of a pivot 126 to a corresponding edge of the port 120. The opposite edge of the shutter rests on a ledge 127 formed along the opposite edge of the port. Thus the shutter 125 can swing inwardly of the developing unit 101 automatically by force of gravity to open the port 120 when the developing unit 101 is in the lower or filling position occupied by the yellow developing unit 101Y in FIG. 5. However, the ledge 127 along the edge of the port 120 prevents the shutter 125 from swinging outwardly and thereby the shutter keeps the port 120 closed to prevent reverse flow of toner out of the developing unit when the developing unit is in the upper position occupied by the cyane developing unit 101C in FIG. 5.

As shown in FIG. 3, the developing unit 101 is accommodated by a corresponding developing unit compartment 301 formed in the rotor 300. From FIG. 3, it will be seen that the magenta developing unit 101M is set up in the compartment 301 in the rotor 300.

Figure 6:
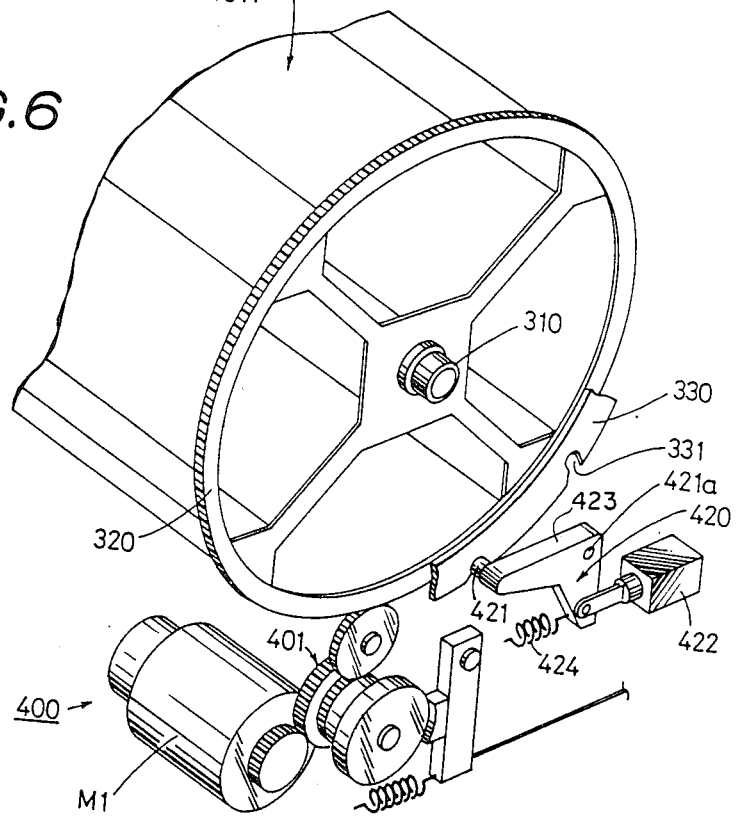
FIG. 6 is a perspective view of the rotary developing device shown in FIG. 3, but viewed from the opposite side thereof.

As also shown in FIG. 3, the rotor 300 is an integral structure and is formed with a plurality of developing unit compartments 301 arranged circumferentially in equally spaced locations. As shown in FIG. 1, a circular bore 302 extends axially of the rotor 300. Referring to FIG. 1, the outer races of bearings 303 and 304 fit in both axial ends of the circular bore 302. The inner races of the bearings 303 and 304 fit on a hollow shaft 310. The rotor 300 is thus rotatably supported on the hollow shaft 310 by means of the bearings 303 and 304. The axis of the hollow shaft 310 extends horizontally and is fixed at both its ends to side walls 50 and 51 of the copying machine through brackets 52 and 53. The rotor 300 thus rotates about a horizontal axis coaxial with the axis of the hollow shaft 310; and it supports the developing units 101 so that they each extend horizontally. The rotor 300 is provided at its inner end (left end as viewed in FIG. 1) with a ring gear 320 so that the rotor 300 is driven by a driving means 400 (see FIG. 6) which includes a driving motor M1 and a gear train 401 meshing with the ring gear 320. The indexing of the rotor 300 is carried out by means of an indexing device 420 which includes a crank arm 423 mounted on a pivot 421*a*. A spring 424 pulls on one end of the crank arm 423 to bias it in a direction such that a pin 421 on another end of the crank arm is forced against an indexing ring 330 on one end of the rotor 300. The indexing ring 330 has slots 331 arranged at predetermined locations about its periphery. When the rotor 300 is turned so as to bring one of the slots 331 into alignment with the indexing pin 421, the spring 424 turns the crank 423 to force the pin 421 into the slot 331 to prevent further rotation of the rotor. The rotor 300 may thereafter be rotated by operating a solenoid 422 corrected to the crank 423 to pull it against the action of the spring, thereby pulling the pin 421 out of the slot 331 and freeing the rotor 300 for further rotation.

The toner supplying system 200 will now be described in detail. The toner supplying system 200 includes the following major constituents: a toner supplying means accommodating the toner to be supplied, a toner transporting means connected between the toner supplying means and the inside of the rotor, i.e., the hollow shaft 310, and adapted to transport the toner into the hollow shaft, and a toner passage means connecting the hollow shaft to the developing units such as to allow the toner to be introduced into the developing units.

Figure 7:
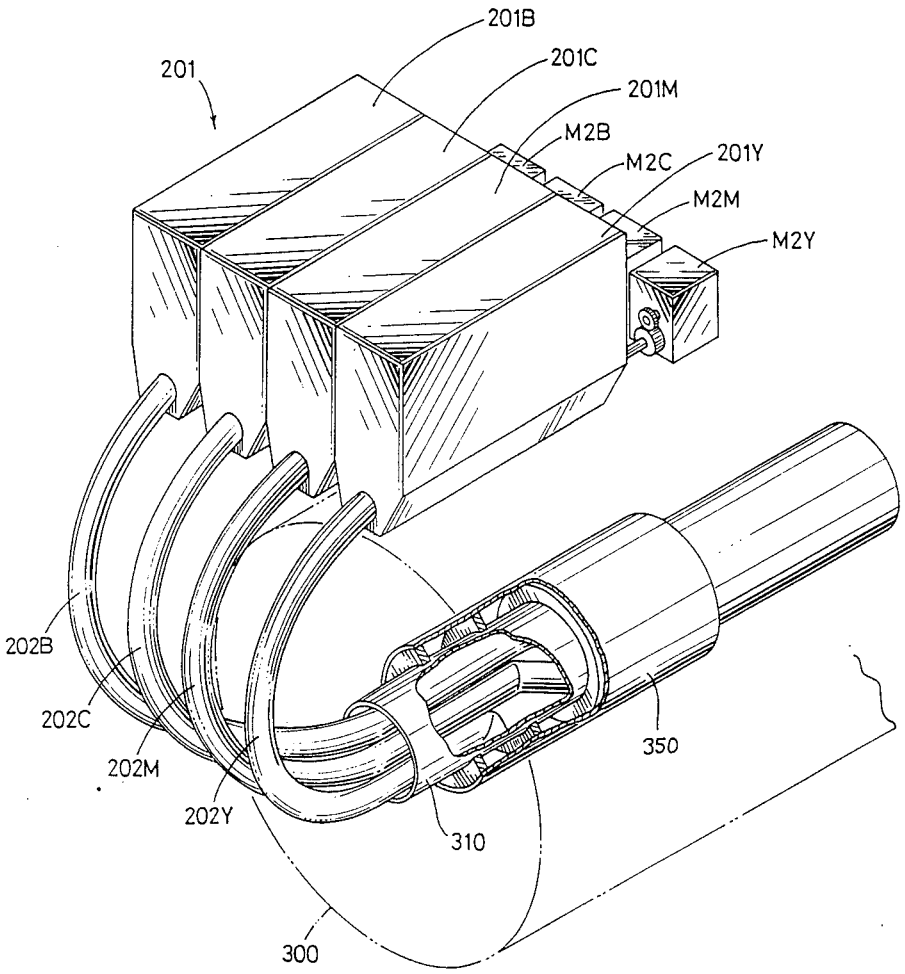
FIG. 7 is a perspective view of a hopper assembly and toner passage means incorporated in the toner supplying system shown in FIG. 1.

Referring to FIGS. 1, 2 and 7, the toner supplying system 200 has a large-sized container 201 containing the toner to be supplied. This container 201 will be referred to herein simply as "hopper 201". The hopper 201 includes a yellow toner hopper unit 201Y, a magenta toner hopper unit 201M, a cyane toner hopper unit 201C and a black toner hopper unit 201B, corresponding, respectively, to the developing units 101Y, 101M, 101C and 101B. The hopper 201 is disposed substantially above the rotary developing device 100.

A yellow toner transporting pipe 202Y, a magenta toner transporting pipe 202M, a cyane toner transporting pipe 202C and a black toner transporting pipe 202B are connected at one of their ends to corresponding hoppers 201Y, 201M, 201C and 201B, respectively, as shown in FIG. 7. The other ends of these pipes lead into the hollow shaft 310, as shown in FIG. 1.

As will be best seen in FIG. 1, an intermediate pipe 350 is disposed oetween the outer periphery of the hollow shaft 310 and the wall of the circular bore 302 in the rotor 300. The intermediate pipe 350 is rotatably supported at both its ends on the hollow shaft 310 through sliding bearings 352 and 353 provided on both axial ends thereof. In consequence, an annular chamber 351 is formed between the hollow shaft 310 and the intermediate pipe 350. Although not necessary to the invention, the thickness or radial breadth of the annular chamber 351 is selected to be about 8 mm (millimeters) in the illustrated embodiment. Partitioning sealing members 354, 355 and 356 are arranged between the hollow shaft 310 and the pipe 350 and are spaced apart from each other in the axial direction of the annular chamber 351 so as to section the space in the annular chamber 351 into annular sub-chambers 351Y, 351M, 351C and 351B. The partitioning sealing members 354 to 356 may constitute slide bearings.

Figure 13:
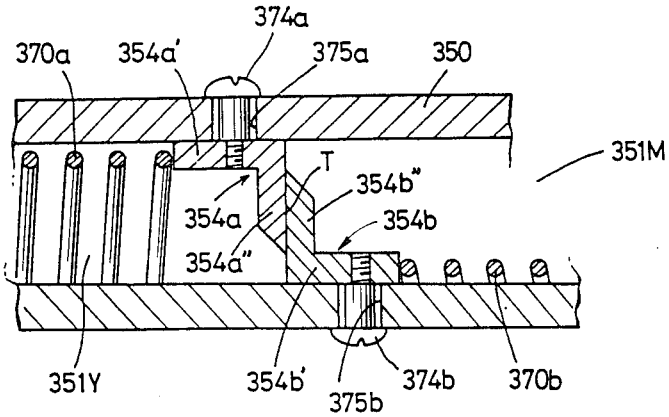
FIG. 13 is an enlarged fragmentary section view showing a partitioning sealing means which may be used in the toner passage means of FIG. 8.

The partitioning sealing means 354 to 356 will now be described in detail. Since the partitioning sealing means 354 to 356 have identical construction, only the partitioning sealing means 354 will be described herein. As will be understood from FIG. 13, which shows the partitioning sealing means on a larger scale, the partitioning sealing means 354 comprises a partition member 354*a* mounted on the inner wall surface of the intermediate pipe 350 and a partition member 354*b* mounted on the outer surface of the hollow shaft 310. The partition member 354*a* has a ring-like annular cylindrical portion 354*a'* and a flange-like annular contacting surface 354*a''* integral with the annular cylindrical portion 354*a'*. Similarly, the partition member 354*b* has a ring-like annular cylindrical portion 354*b'* and a flange-like annular contacting surface 354*b''* integral with the cylindrical portion 354*b'*. The annular contacting surface 354*a''* faces the annular contacting surface 354*b''*. More specifically, the partition member 354*a* is urged towards the partition member 354*a* by a compression spring 370*a* interposed between the partition member 354*a* and an adjacent bearing 352 (FIG. 1), while the partition member 354*b* is urged towards the partition member 354*a* by a compression spring 370*b* interposed between the partition member 354*b* and the adjacent partition member 355 (FIG. 1), so that contacting surfaces 354*a''* and 354*b''* make contact with each other as at T. A stepped screw 374*a* provided on the cylindrical portion 354*a'* engages with an axially elongated hole 375*a* formed in the intermediate pipe 350 so that the partition member 354*a* turns with the intermediate pipe 350 but is permitted a limited amount of axial movement on the pipe. Similarly a stepped screw 374*b* provided on the cylindrical portion 354*b'* engages with an axially elongated hole 375*b* formed in the hollow shaft 310 so that the partition member 354*b* is prevented by the shaft 310 from rotating but is permitted a limited amount of axial movement on the shaft.

Figure 15:
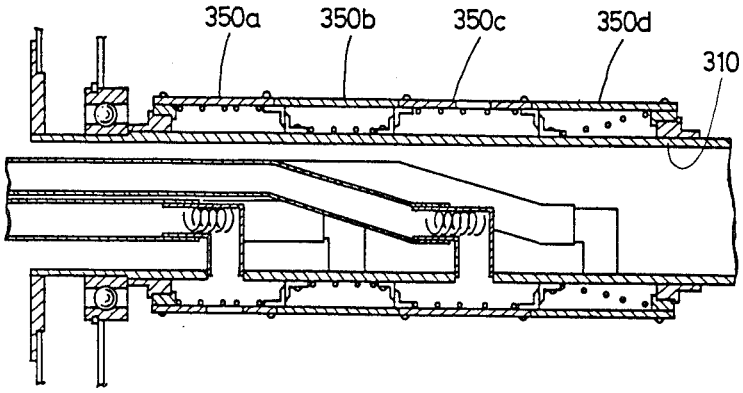
FIG. 15 is an axial section view similar to FIG. 9 but showing an alternate toner passage means according to this invention.

According to this arrangement of the partitioning sealing means constituted by the partition members 354*a* and 354*b*, the toners in the annular sub-chambers 351Y and 351M are prevented from coming into the other annular sub-chambers through the area T of contact between both partition members 354*a* and 354*b*, because there is no gap in this contact area. Preferably, the inner periphery and outer periphery of the annular contacting surfaces 354*a''* and 354*b''* of both partition members 354*a* and 354*b* are tapered as shown so as to prevent the toners from coming into the annular contact region T. The overall arrangement of the above described partitioning sealing means is shown in FIG. 15.

Figure 14:
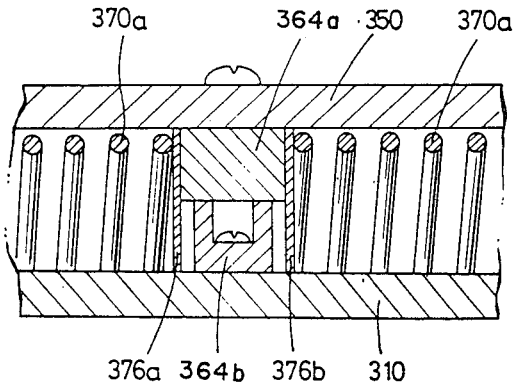
FIG. 14 is an enlarged fragmentary section view similar to FIG. 13 but showing another example of a partitioning sealing means which may be used in the toner passage means of FIG. 8.

FIG. 14 shows another example of a partitioning sealing means according to this invention. In this example, the partitioning sealing means has a partition member 364*a* fixed to the intermediate pipe 350 and a partition member 364*b* fixed to the hollow shaft 310. Both partition members 364*a* and 364*b* are arranged such that the inner peripheral surface of the partition member 364*a* and the outer peripheral surface of the partition member 364*b* contact each other. The partition member 364*a* has a greater axial thickness than the partition member 364*b*. In addition, annular pressure contact members 376*a* and 376*b* are held in pressure contact with both annular side surfaces of the partition member 354*a* by means of springs 370*a* and 370*b*.

The lower portion of the wall of the hollow shaft 310 as viewed in FIG. 1 is provided with toner supplying ports 361Y, 361M, 361C and 361B which communicate with the annular sub-chambers 351Y, 351M, 351C and 351B, respectively. To the toner supplying ports 361Y, 361M, 361C and 361B are connected the ends of the yellow toner transporting pipe 202Y, the magenta toner transporting pipe 202M, the cyane toner transporting pipe 202 and the black toner transporting pipe 202B, respectively.

Figure 8:
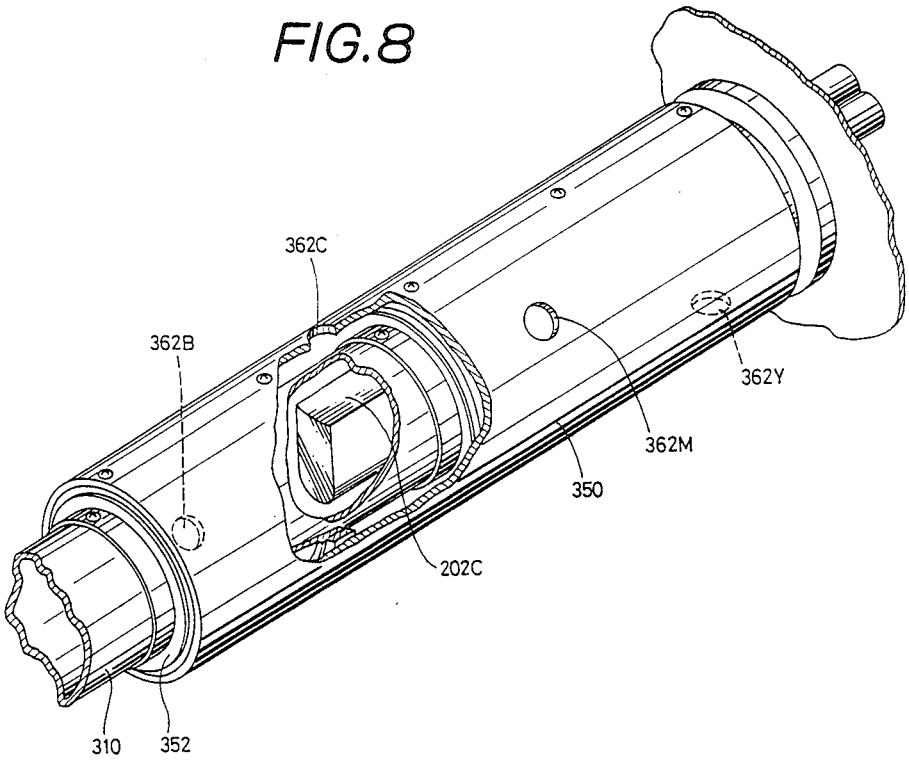
FIG. 8 is an enlarged and partly sectioned perspective view of the toner passage means in the toner supplying system of FIG. 7.

On the other hand, relay ports 362Y, 362M, 362C and 362B are formed in the portions of the wall of the intermediate pipe 350 defining the annular sub-chambers 351Y, 351M, 351C and 351B, in alignment with the receiving ports 120 of respective developing units and respective openings 305 in the rotor 300. Thus, the relay ports 362Y, 362M, 362C and 362B are formed at 90° intervals, respectively, as will be seen from FIGS. 1 and 8. The intermediate pipe 350 is fixed to the rotor 300 by a suitable means which is not shown. Therefore, the intermediate pipe 350 is rotated together with the rotor 300 so that one of the relay ports is brought to the lowermost position at each 90° rotation of the rotor 300. A ring-shaped sealing member 306 made of a suitable material such as urethane foam is provided between the intermediate pipe 350 and the rotor 300 at each side of each opening 305 in the rotor 300.

Figure 9:
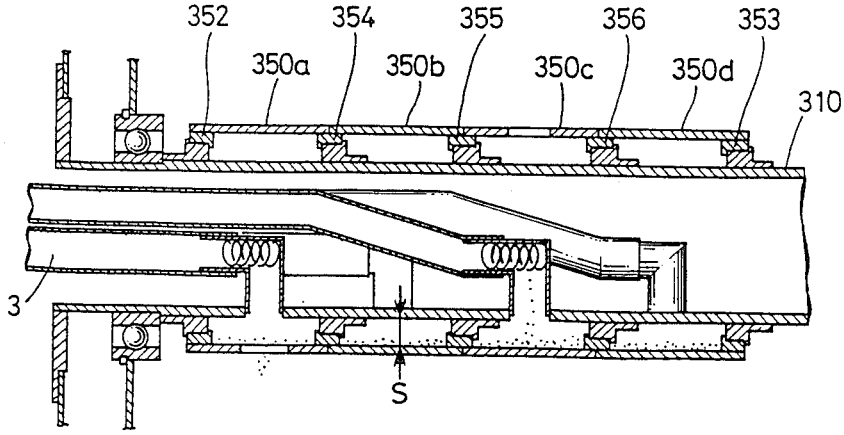
FIG. 9 is an axial section view of an alternate toner passage means in accordance with this invention.
Figure 16:
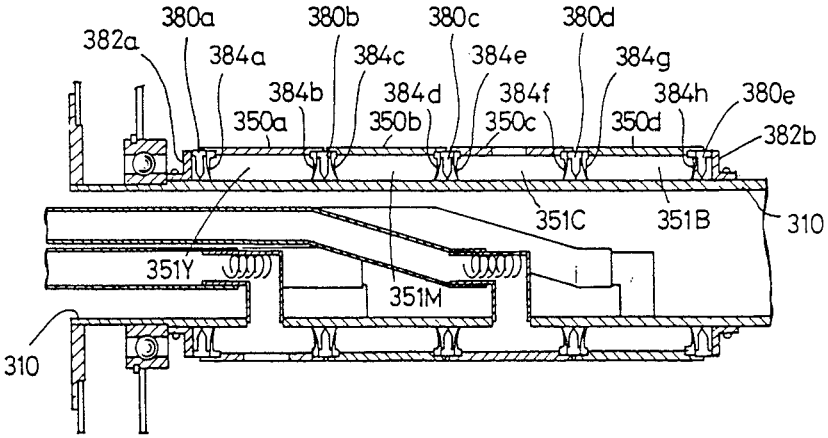
FIG. 16 is an axial section view similar to FIG. 9 but showing another alternate toner passage means according to this invention.

Although in the described embodiment the intermediate pipe 350 is an integral member, this is not necessary to the invention and the intermediate pipe 350 may instead be composed of a plurality of, e.g., four, pipe segments 350*a*, 350*b*, 350*c* and 350*d*, as shown in FIG. 9. In this case, it is preferred that the partition sealing members 354, 355 and 356 serve also as bearings. The use of a segmented intermediate pipe permits greater variation in the alignment of the partition sealing members than is available when an integral intermediate pipe is used. FIG. 16 shows an embodiment in which the intermediate pipe 350 is composed of four segments 350*a*, 350*b*, 350*c* and 350*d* as in the case of the embodiment shown in FIG. 15. This embodiment, however, is distinguished from the embodiment shown in FIG. 15 by the construction of the partitioning sealing members. Namely, in the embodiment shown in FIG. 16, the intermediate pipe segments 350*a*, 350*b*, 350*c* and 350*d* are rotatably supported on the hollow shaft 310 by means of supporting rings 380*a* to 380*e*. More specifically, the intermediate pipe segment 350*a* is rotatably supported at its both ends by the hollow shaft 310 through support rings 380*a* and 380*b* which engage at their outer peripheral surfaces with both ends of this intermediate pipe segment 350*a*. The intermediate pipe segments 350*b*, 350*c* and 350*d* are supported in similar manner through support rings 380*b* and 380*c*, through support rings 380*c* and 380*d* and through support rings 380*d* and 380*e*, respectively. In order to minimize the area of contact with the hollow shaft 310, each of the support rings 380*a* to 380*e* is provided with an inner peripheral surface in the form of a knife edge. The outermost support rings 380*a* and 380*e* slidably contact with side retainers 382*a* and 382*b* fixed to the hollow shaft 310, so that the support rings 380*a* to 380*e* are prevented from moving in the axial direction along the hollow shaft 310. Thus, the hollow shaft 310 and the intermediate pipe segments 350*a* to 350*d* in cooperation define annular sub-chambers 351Y, 351M, 351C and 351B.

In order to prevent the toners in respective sub-chambers 351Y. 351M, 351C and 351B from coming into adjacent sub-chambers, sealing members 384*a* to 384*h* are disposed adjacent the support rings 380*a* to 380*e* within respective annular sub-chambers. The sealing members 384*a* to 384*h* are ring-like members made of an elastic material, such as a rubber; and they are secured at their outer peripheral surfaces to the intermediate pipe 350 while making a resilient sliding contact with the outer peripheral surface of the hollow shaft 310.

A toner feeding screw 203 extends along the interior of each of the pipes 202 which connect the hopper units 201 to corresponding annular sub-chambers 351. Each screw 203 has a length such that its one end is located near the corresponding toner supplying port 361, while the other end is connected to a driving motor M2 for driving the toner feeding screw 203. As the toner feeding screw 203 operates, the toner in the hopper 201 is driven forward through the pipe 202 to the toner supplying port 361. The toner then falls through the port 361 into the annular sub-chamber 351. Since the annular sub-chambers 351 are separated from each other by the bearings and the partition sealing members 352, 353, 354, 355 and 356, there is no risk of the different color toners being mixed with each other or being scattered outside the hollow shaft 310.

It is to be noted also that, since the annular sub-chambers 351 are defined by the coaxially arranged stationary hollow shaft 310 and rotatable intermediate pipe 350 so as to have a radial clearance S of, for example, 8 mm, there is no risk of the intermediate pipe 350 becoming locked or causing an increase in the rotor driving load which might otherwise be caused by clogging of the toner.

The operation of the above described toner supplying device 200 and the rotary developing device 100 will now be described.

Referring to FIG. 5, the yellow developing unit 101Y is shown in the toner supplying position. The rotor 300 rotates clockwise as shown by the arrow B in FIG. 5. After a developing operation, the developing unit 101Y is rotated 90° to the toner supplying position where it is disposed horizontally in the bottom position of the rotor 300. It will be seen that external leakage and scattering of the toner can be avoided even in this state.

As the rotor 300 rotates, the toner reverse flow prevention shutter 125Y for the toner receiving port 120Y is gradually rotated about its pivot axis 126 by the force of gravity to open the toner receiving port 120Y. When the yellow developing unit 101Y has been brought to the toner supplying position as shown in FIG. 5, the reverse flow prevention shutter 125Y is suspended vertically from its pivot shaft 126 such as to fully open the toner receiving port 120Y. Then the motor M2 is energized to drive the toner feeding screw 203Y (FIG. 1) so that the toner in the yellow hopper 201Y is supplied from the yellow hopper 201Y into the development preparatory chamber **111*c* of the developing unit 101Y, through the toner supply port 351Y, the annular sub-chamber 351Y and the relay port 362Y**.

After the completion of the supply of the toner, the yellow developing unit 101Y is further rotated 90° as a result of the rotation of the rotor 300 and is brought to a vertical position which is, in FIG. 5, occupied by the black developing unit 101B. The developing agent in the developing chamber 111, particularly in the first developing chamber **111*a*, is moved into the development preparatory chamber 111*c* together with the toner supplied from the yellow hopper 201Y. During this movement, the developing agent and the toner are mixed with each other to some extent. Meanwhile, the shutter 125Y is rotated by the force of gravity such as to close the toner receiving port 120Y against the ledge 127. A further rotation of the rotor 300 brings the yellow developing unit 101Y to an inverted position on the top of the rotor 300 which is, in FIG. 5, occupied by the cyane developing unit 101C. In this state, the toner reversing shutter 125Y closes the toner receiving port 120Y** completely so that there is no possibility of the toner leaking from the developing unit.

By a further 90° rotation of the rotor 300, the yellow developing unit 101Y is brought to the developing position which is, in FIG. 5, occupied by the developing unit 101M. During this movement, the developing agent in the development preparatory chamber 111C flows towards the first developing chamber **111*a* by the force of gravity. In order to produce a static stirring of the developing agent, it is preferred to provide a stirring projection 109 on the rear wall 104 of each developing unit 110. It will be seen that the developing agent and the toner are mixed with each other to a substantially uniform extent due to the flowing and stirring movement which takes place during the rotation of the rotor 300**.

A uniform thickness of the developing agent is obtained in the first developing chamber **111*a* by the action of the stirring screws 112 and 113. From the view point of uniformity of the toner density in the developing agent, it is preferred that the toner supplying port be disposed as closely as possible to the upstreamside end of the stirring screw 112 as viewed in the conveying and stirring direction of the developing agent, so as to maximize the capacity or volume for the supply of the toner and to maximize the length of passage for the conveyance and stirring of the agent by the stirring screw 112**.

Figure 17:
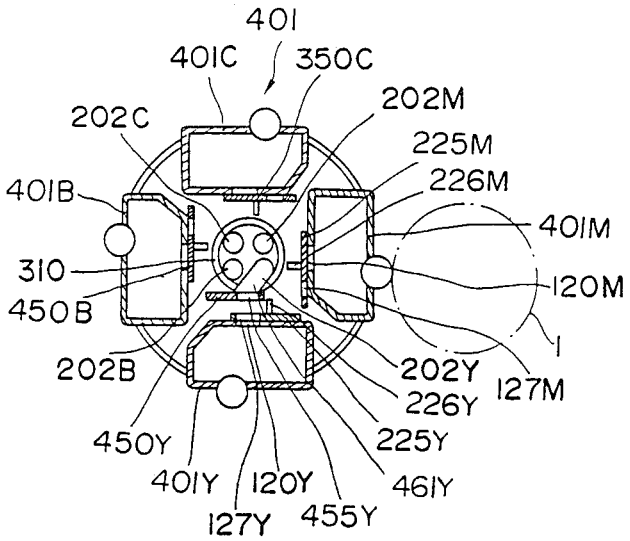
FIG. 17 is a schematic cross-sectional view of a rotary developing device constituting another embodiment of the toner supplying systex: of the invention.
Figure 18:
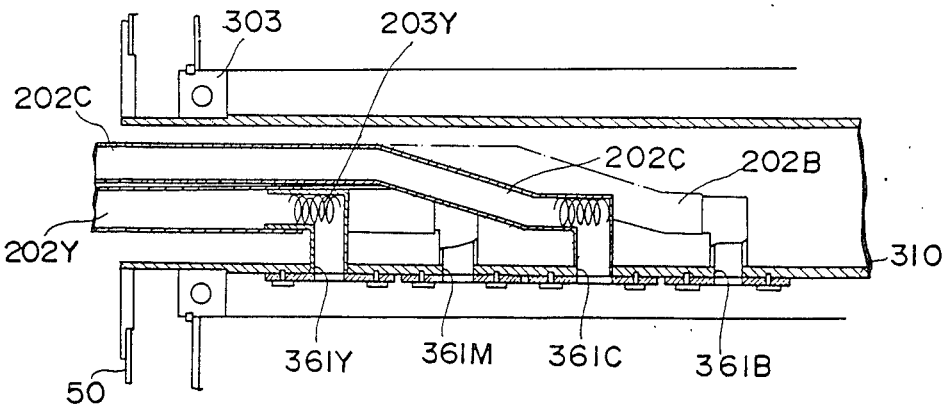
FIG. 18 is an axial section view of a toner passage means used in the embodiment of FIG. 17.

Another form of toner passage means will now be described with reference to FIGS. 17 to 21. FIG. 17 is a cross-sectional view similar to FIG. 5, but showing different developing devices 401. In FIG. 17, some of constituents are not shown or are shown schematically, for purposes of clarification. FIG. 18 shows a toner passage means 200 similar to that shown in FIG. 1. Portions which are not critical to this explanation are also omitted from FIG. 18. Also those elements in FIGS. 17 to 21 which are the same as or similar to corresponding elements in the preceeding figures will be given the same reference numerals.

Figure 19:
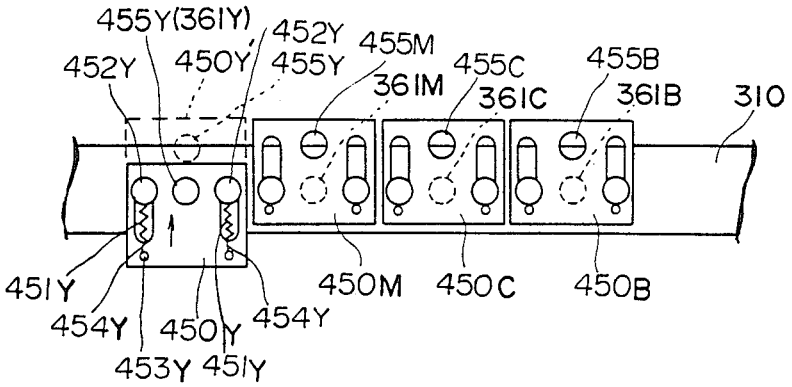
FIG. 19 is a bottom plan view of a hollow shaft and shield plate arrangement used in the toner passage means of FIG. 17.

As will be best seen from FIGS. 17 to 19, the toner supplying port 361Y of the hollow shaft 310 is normally closed by a shield plate 450Y which is disposed under the toner supplying port 361Y. The shield plate 450Y as shown, has a generally rectangular form. Elongated holes 451Y are formed in both ends of the shield plate 450Y and slidably engage pins 452Y provided on the hollow shaft 310. The holes 451Y are elongated in the direction of movement of the plate between opening and closing positions, uncovering and covering respectively, the toner supplying port. Pins 453Y are provided on the ends of the shield plate 450Y adjacent one of the longitudinal ends of the elongated holes 451Y. Tensile springs 454Y are stretched between the pins 453Y and adjacent pins 452Y. According to this arrangement, the shield plate 450Y is biased undirectionally to a position 450Y' indicated by the dashed outline in FIG. 19, so that the toner supplying port 361Y is closed by the shield plate 450Y. However, when the shield plate 450Y is moved in a direction perpendicular to the axis of the hollow shaft 310 to the solid line position shown in FIG. 19 by full line, as indicated by the arrow C, by a suitable means which will be explained later, an opening 455Y provided in the shield plate 450Y becomes aligned with the supplying port 361Y in the hollow shaft 310, thus opening the supplying port 361Y. Similarly, other shield plates 450M, 450C and 450B are associated with other supplying ports 361M, 361C and 361B, respectively. The shield plates 450M, 450C and 450B have the same construction as the shield plate 450Y and operate in the same way as the latter.

Figure 20:
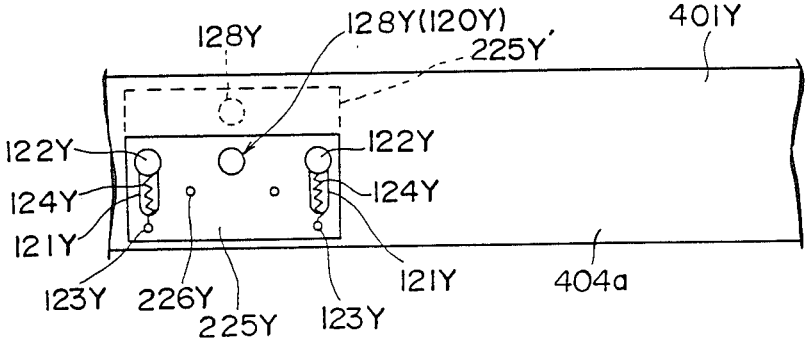
FIGS. 20 and 21 are fragmentary views showing shutter plates and developing units of the toner passage means of FIG. 17.
Figure 21:
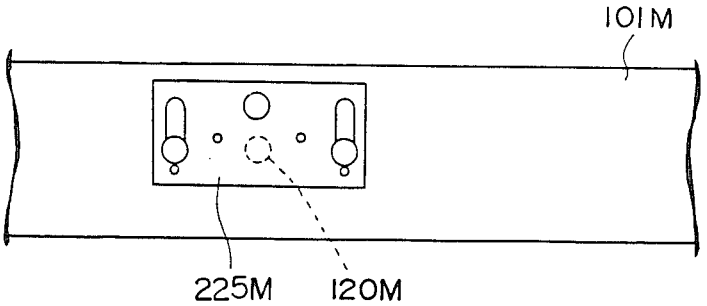

The toner receiving port 120Y in the developing unit 401Y is normally closed by a shutter plate 225Y. More specifically, the shutter plate 225Y has a rectangular form and is provided at its both ends with elongated holes 121Y which slidably engage pins 122Y on the vertical rear wall portion **404*a* of the developing unit 401Y as shown in FIG. 20. The holes 121Y are elongated in the direction of movement of the shutter plate between opening and closing positions covering and uncovering, respectively, the toner receiving port 120Y. Pins 123Y are provided on the portions of the shutter plate 225Y adjacent one end of respective elongated holes 121Y. Tensile springs 124Y are stretched between the pins 123Y and the pins 122Y so that the shutter plate 125Y is normally biased to a position 225Y' shown in dashed outline in FIG. 20. In this state, the receiving port is 120Y is closed by the shutter plate 225Y. However, when the shutter plate 225Y is moved in a direction perpendicular to the longitudinal axis of the developing unit 401Y by the action of a cam pin 226Y provided on a suitable portion of the shutter plate 225Y, an opening 128Y formed in the shutter plate 225Y** is brought into alignment with the toner receiving port 120Y, thus opening the latter.

Corresponding shutter plates, similar to the shutter plate 225Y are associated with the toner receiving ports 120M, 120C and 120B, respectively of the other developing units 401M, 401C and 401B. The positions of these shutter plates are offset in the longitudinal direction of the direction of their respective developing units in such a manner as to correspond to the positions of the shield plates 450Y, 450M, 450C and 450B attached to the hollow shaft 310 in FIG. 19.

The operation of the toner passage means having the above described construction will now be explained.

Referring to FIG. 17, the developing unit 401Y is shown in the toner supplying position, while the developing unit 401M is snown in the developing position. The shutter plate 225M of the developing unit 401M which is in the developing position is urged by its spring 124M to close the associated toner receiving port 120M.

When the rotor 300 is rotated to bring the developing unit 401M from the developing position to the toner supplying position, the cam pin 226M on the shutter plate 225M of this developing unit abuts the end surface of the shield plate 450M before the developing unit 401M reaches the toner supplying position. The abutment between the cam pin 226M and the end surface of the shield plate 450M prevents any further movement of the shutter plate 225M, so that relative movement is produced between the shutter plate 225M on the developing unit 401M and the developing unit itself. Consequently, the opening 128M in the shutter plate 225M is progressively brought into alignment with the toner receiving port 120M in the developing unit 401M. Then, the ends of the elongated holes 121M in the shutter plate 225M are brought into contact with corresponding pins 122M, so that the shutter plate 120M starts to move again together with the developing unit. In this state, the toner receiving port 120M and the opening 128M in the shutter plate 225M are perfectly aligned with each other, so that the toner receiving port 120M is opened.

The described operation of the rotor 300 and the shutter plate 225M causes the cam pin 226M to move the shield plate 450M against the force of its spring 454M (not shown), so that the opening 455M in the shield plate 450M becomes aligned with the toner supplying port 361M in the hollow shaft 310, whereby the toner supplying port 361M is opened when the developing unit has been brought to the toner supplying position.

Thus, the toner supplying port 361M in the hollow shaft 310 and the toner receiving port 120M in the developing unit 401M are brought into alignment and communication with each other as the developing unit is moved from the developing position to the toner supplying position. When the toner density in the developing unit in the toner supplying position is below a predetermined level, the driving motor M2 in the hopper corresponding to this developing unit is started to supply the toner into the toner supplying port 361 of the hollow shaft. The toner then drops by the force of gravity into the developing unit through the toner receiving port which is opened.

Further rotation of the developing device causes the cam pin 126M on the developing unit to be disengaged from the end surface of the shield plate 450M on the hollow shaft 310, so that the shield plate 450M and the shutter plate 225M are returned to their starting positions by their respective springs 454M and 124M, thus closing the toner supplying port 361M and the toner receiving port 120M. Therefore, even though the developing unit is turned sideways and then upside down in successive positions which, in FIG. 5 and 17, are occupied by the black and cyane developing units, respectively, the developing agent is prevented from being scattered outside.

Figure 22:
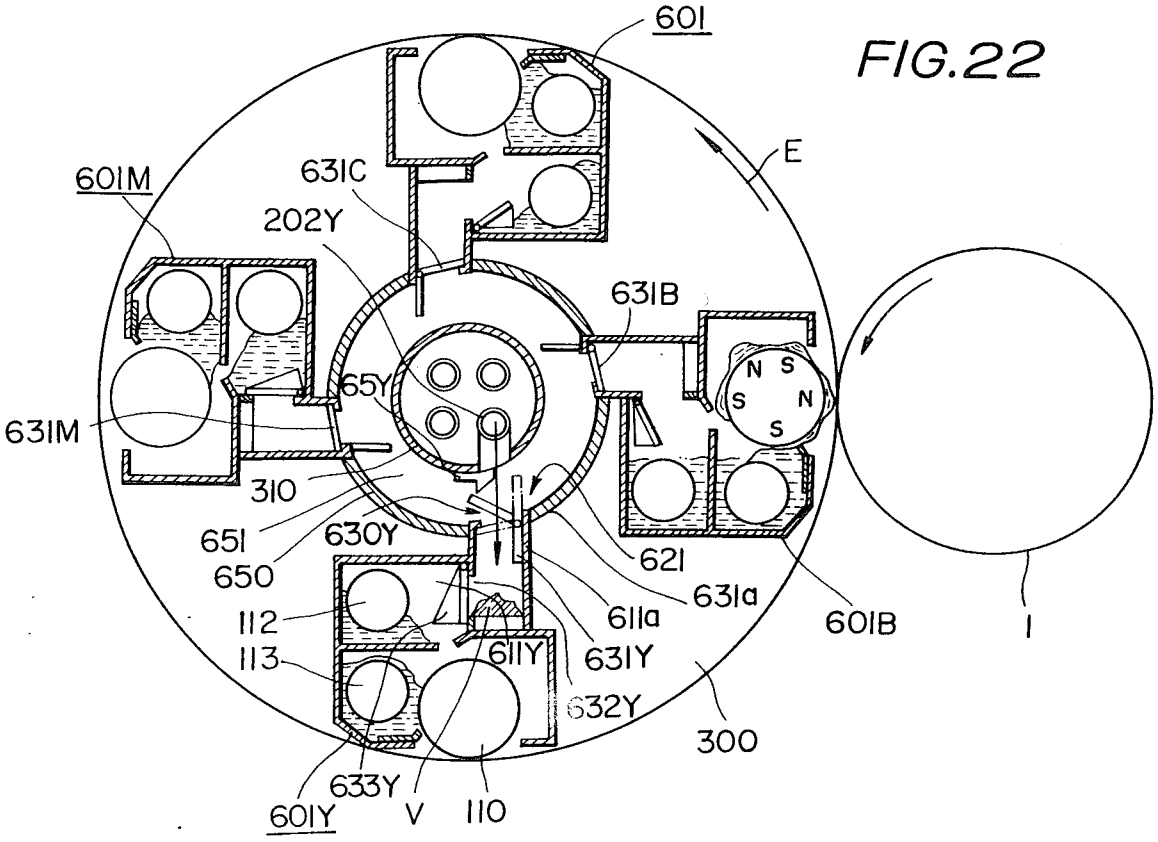
FIG. 22 is a schematic cross-sectional view of a rotary developing device and toner supplying system in accordance with a still further embodiment of the invention.
Figure 23:
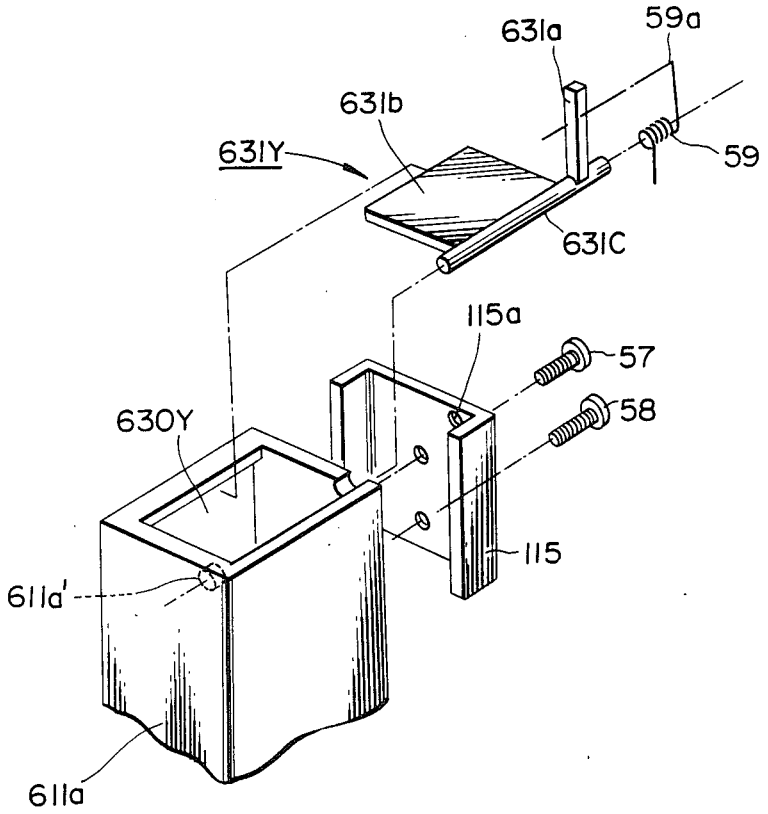
FIG. 23 is an exploded perspective view showing a shutter construction used in the embodiment of FIG. 22.

FIGS. 22 and 23 show another embodiment of a developing device according to the present invention.

As shown in FIG. 22 there are provided developing units 601Y, 601M, 601C and 601B which are supported in a rotor 300 by suitable means (not shown). The rotor 300 is rotatable in the direction of the arrow E by driving means as described in the preceeding embodiments. A hollow shaft 310 is fixed to the body of the developing device at the center of rotation of the rotor 300. A plurality of toner transporting pipes 202Y, 202M, 202C and 202B are provided in the hollow shaft 310. The rotor 300 is also provided with a cylindrical pipe 650 concentric with the hollow shaft 310. This arrangement forms an annular space 651 between the hollow shaft 310 and the cylindrical pipe 650. A cam 65Y is attached to the hollow shaft 310. The cam 65Y is engaged with a shutter of a developing unit 601Y as mentioned will be described more fully below. Other cams of this type are arranged in axially spaced relationship along the hollow shaft 310 so as to be engaged with shutters of associated developing units 601M, 601C and 601B, respectively.

The shutter construction for the developing unit 601Y will now be described. As shown in FIG. 22 the developing unit 601Y is formed with a developing agent supplying port 630Y at a developing agent receiving portion 611*a* of a developing vessel 611Y thereof. The developing agent receiving portion 611*a* where the port 630Y is formed therein is in communication with an opening 621 formed in the cylindrical pipe 650. A shutter member 631Y is arranged to open and shut the port 630 and a shutter lever 631*a* is arranged to be engaged with the cam 65Y. An opening 632Y is formed at the inner portion of the developing vessel 611Y and is opened and shut by a lid 633Y. The lid 633Y rotates in the direction of closing the opening 632Y by the force of the developing agent when the developing unit 601Y moves from the position of the developing unit 601C as shown in FIG. 22 to the position of the developing unit 601M. In this manner, the developing agent is prevented from flowing out of the vessel 611Y when the developing vessel is inverted (e.g. to the orientation of the developing unit 601M as shown in FIG. 22). The lid 633Y rotates, owing to its weight, and thereby opens the opening 632Y when the developing unit 601Y moves form the position as shown in the drawing to the developing position ( i.e., the position of the developing unit 601B as shown in FIG. 22).

The shutter 631Y is normally biased by a coil spring 53 to the position shown in FIG. 22 by a dotted line and in this position the shutter closes the port 630Y. As shown in FIG. 23, the shutter lever 631*a* extends at an angle from the shutter 631Y. The shutter lever 631*a* of the shutter 631Y abuts the cam 65Y attached to the hollow shaft 310 when the developing unit 601Y moves from the position of the developing unit 601M in FIG. 22 to the position of the developing unit 601Y in FIG. 22. The shutter lever 631*a* is rotated against the coil spring biasing force by the cam 65Y as the developing units move in the direction of the arrow E. In this manner the shutter 631Y shutting the port 630Y is shifted to its solid line position as shown in FIG. 22, thereby uncovering the opening 630Y. In this condition, the developing agent is supplied to the developing unit 601Y. Accordingly, the position of the developing unit 601Y in FIG. 22 is the developing agent supplying position for each developing unit. FIG. 22 shows the condition in which the developing agent is supplied in the developing unit 601Y. The developing agent falls from the pipe 202Y included in the hollow shaft 310, and passes through the port 630Y under gravity and into the developing vessel 611Y. The developing agent supplied to the developing vessel 611Y is indicated at V in FIG. 22.

When the developing unit 601Y moves in the direction of the arrow E beyond the position shown where the developing agent is supplied, the engagement of the shutter lever 631*a*with the cam 65Y is released and the shutter 631Y closes the opening 630Y by the biasing force of the coil spring. While the developing unit 601Y moves to the developing position, the lid 633Y rotates by virtue of its own weight and opens the opening 132. Thereafter, the developing agent which had been supplied to the developing vessel portion 611*a* is mixed with the developing agent already in the developing vessel 611Y.

The details of the shutter 631Y which opens and closes the port 630Y are best seen in the exploded perspective view of FIG. 23. The shutter 631Y is an integral unit which comprises a shutter plate 631*b*, a pivotable shaft 631*c* for pivotably connecting the shutter plate 631*b* with the developing agent receiving portion 611*a*, and the shutter lever 631*a* for effecting opening and closing movement of the shutter plate 631*b* by engaging the cam 65Y attached to the hollow shaft 310.

The pivotable shaft 631*c* is fitted at one end thereof with a bearing port 611*a'* formed at the end portion of the port 630Y of the development agent receiving portion 611*a*. The other end of the pivotable shaft 631*c* is fitted into a bearing port 115*a* of a plate 115. The plate 115 in turn is attached by screws 57 and 58 to a side portion of the development agent receiving portion 611*a*. Further, a coil spring 59 is mounted to the shutter 631Y in the manner that the coil portion of the spring is wound around the pivotable shaft 631*b* and one end 59*a* of the spring is hung from the shutter lever 631*a*. Accordingly, the shutter 631Y is biased in the direction of always closing the port 630Y by the coil spring 59, i.e. in the clockwise direction around the pivotable shaft 631*c* as viewed in FIG. 22.

Shutters as above described are provided in each developing unit and the developing agent is supplied to the respective developing units by opening the associated shutter when the respective developing unit is brought to its developing agent supplying position.

The supply of developing agent and the control of shutter movement is the same for each of the developing units as has been described above for the developing unit 601Y.

Each port 630 of the cylindrical member 650, to which each developing unit is connected, is shifted circumferentially by 90° and is axially shifted on the cylindrical member relative to the next adjacent port so as to correspond to the position of the cams 65 attached to the bottom of the hollow shaft 310. Accordingly, the developing agent receiving portion 611 of each developing unit which is connected to an associated opening 630 of the cylindrical member 650, is located at a circumferential position differing from the other developing agent receiving portions in the longitudinal direction of the developing unit.

It will be seen from the foregoing that a predetermined amount of developing agent is supplied to each developing unit when the cam 65M of that unit engages with its respective shutter, i.e. when the cam 65M engages the shutter 631M of the developing unit 101M, when the cam 65C engages the shutter 631C of the developing unit 601C, when the cam 65B engages the shutter 631B of the developing unit 601B and when the cam 65Y engages the shutter 631Y of the developing unit 601Y, respectively.

Figure 10:
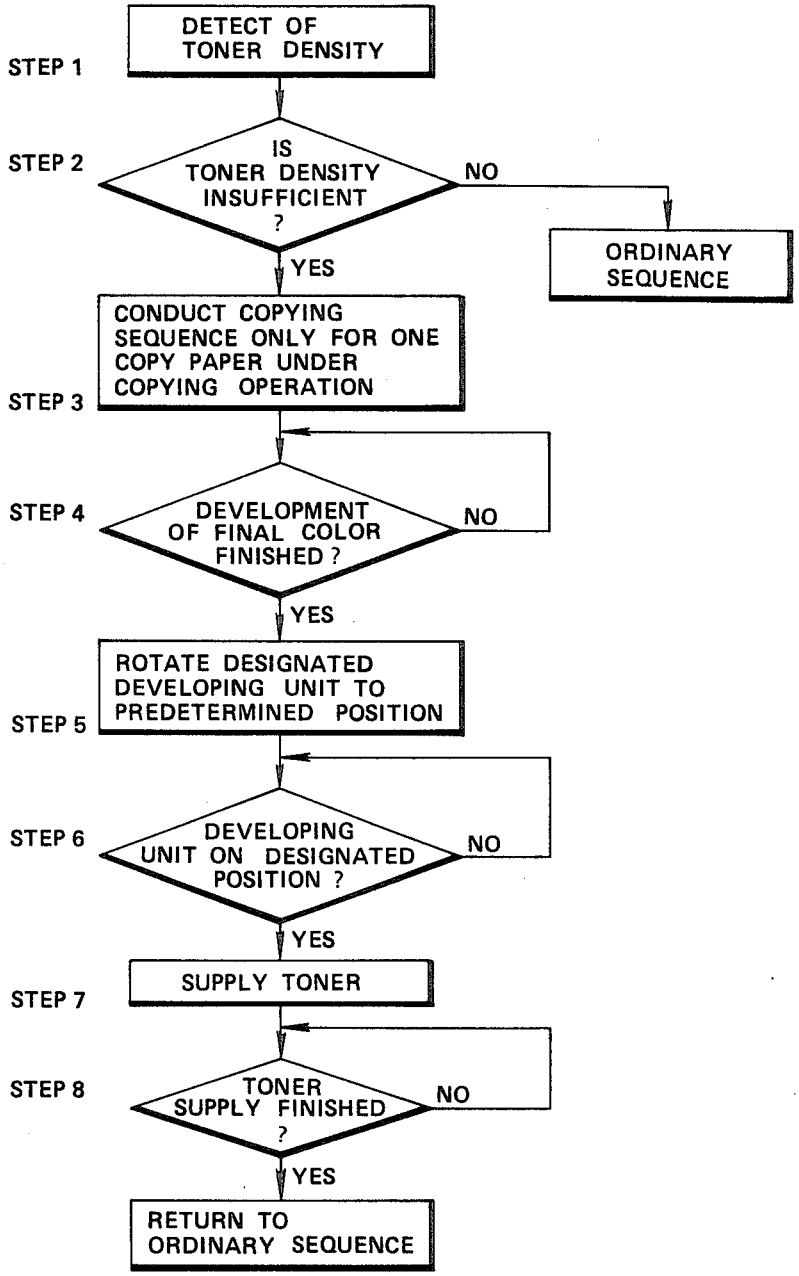
FIG. 10 is a flow chart explaining the operation of a toner supplying system according to this invention.
Figure 11:
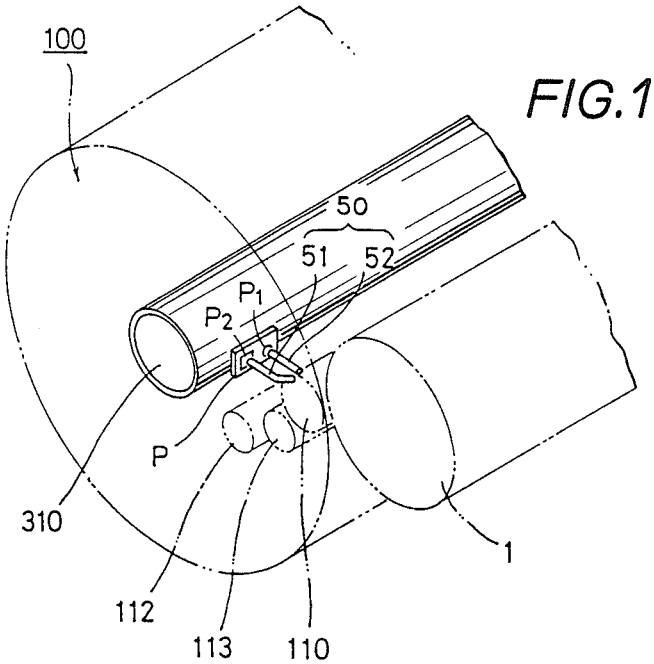
FIG. 11 is a perspective view of an example of a toner density detecting means used in connection with the toner supplying system of FIG. 1.

FIG. 10 is a flow chart showing the operation of the toner supplying system in accordance with the invention. In operation of the system, the density of the toner of the developing agent coating the developing roller of the developing unit is detected in step 1. The detection of the toner density is carried out with respect to the developing unit brought to the developing position which is, in FIG. 5, occupied by the magenta developing unit 601M. The detection of the toner density can be conducted in various ways, an example of which is shown in FIG. 11. Referring to FIG. 11, a toner density detector P has a light source $P_1$ and a light-receiving element $P_2$, and is fixed to the hollow shaft 310. In addition, a detecting section 50, composed of optical guides 51 and 52, is secured to the rotor 300 or each respective developing unit. The optical guides 51 and 52 each have one end positioned near the surface of the developing roller 110 of the respective developing unit, while the other end of each optical guide is located to be brought into position adjacent the respective light source $P_1$ and light receiving element $P_2$ when the respective developing unit comes to the developing position. When one of the developing units is disposed at the developing position, the light coming from the light source $P_1$ is projected onto the surface of the developing roller through the optical guide 52, and the light reflected by the developing roller surface is received by the light receiving element $P_2$. The amount and, hence, the density of the toner in the developing agent can be known from the quantity of the light reflected by the developing roller. This arrangement simplifies the application of electrical power to the detector P because the detector P is fixed. In addition, the positioning of the detector P and the detecting section 50 is facilitated because the detector can be located near the axis of rotation of the developing unit.

Referring now to FIG. 10, when the detection in step 1 indicates that the toner density in the developing unit is sufficient, normal control is carried out for the production of color copy. However, when the detection indicates that the toner density is too low, a decision is made to allow the copying operation to continue only on the copying paper which is now under the copying operation. This selection and operation are conducted in steps 2 and 3 of the process.

When the toner density is too low, a judgment is made in step 4 as to whether the color copying on the last copying paper in process has been completed. If the color copying operation has been completed, the copying process for the next sheet of paper is not started but instead, in step 5, the developing unit which has been judged to have too low toner density is brought to the toner supplying position shown in FIG. 5. In step 6, a judgment is made as to whether the developing unit mentioned above has been brought to the designated position. In step 7, the toner supply conveyer for the toner corresponding to this developing unit is started. Thereafter, in step 8, the process is switched to the normal copying sequence after confirmation of completion of the toner supplying operation. Thus, the continuous copying operation, which had been interrupted, is started again to produce a desired number of copies. The sequence of steps may be arranged such that toner density is detected not only in the developing unit which is undergoing a developing operation, but also in a developing unit which is passing through the detecting position. However, considering that the toner is consumed during the developing operation, the detection of toner density for a developing unit which is not to be used in the development is less significant.

If a developing unit is not to be used in the next developing operation, it need not be stopped at the developing position, i.e., the detecting position. Rather, such developing unit may be made to pass through the detection position at high speed. The detection of the toner density for the developing unit running at high speed inevitably impairs the precision of detection and necessitates a judging means having a high grade of judging function. From these points of view, it is practical and preferred to conduct the detection of toner density only for the developing unit which is located at the developing or detecting position for the developing operation.

In order to allow confirmation of the kind or color and the position of the developing unit under toner density detection, it is possible to use a known detector S (FIG. 1) for detecting the kind and position of the developing unit. The detector S may be fixed to the hollow shaft 310 as in the case of the toner density detector P, so as to receive a signal representing the kind or color of the developing agent and a signal representing the position of the developing unit through an optical guide.

The toner density detector P and the color/position detector S may be fixed to the stationary body of the copying machine instead of being fixed to the hollow shaft 310.

Figure 12:
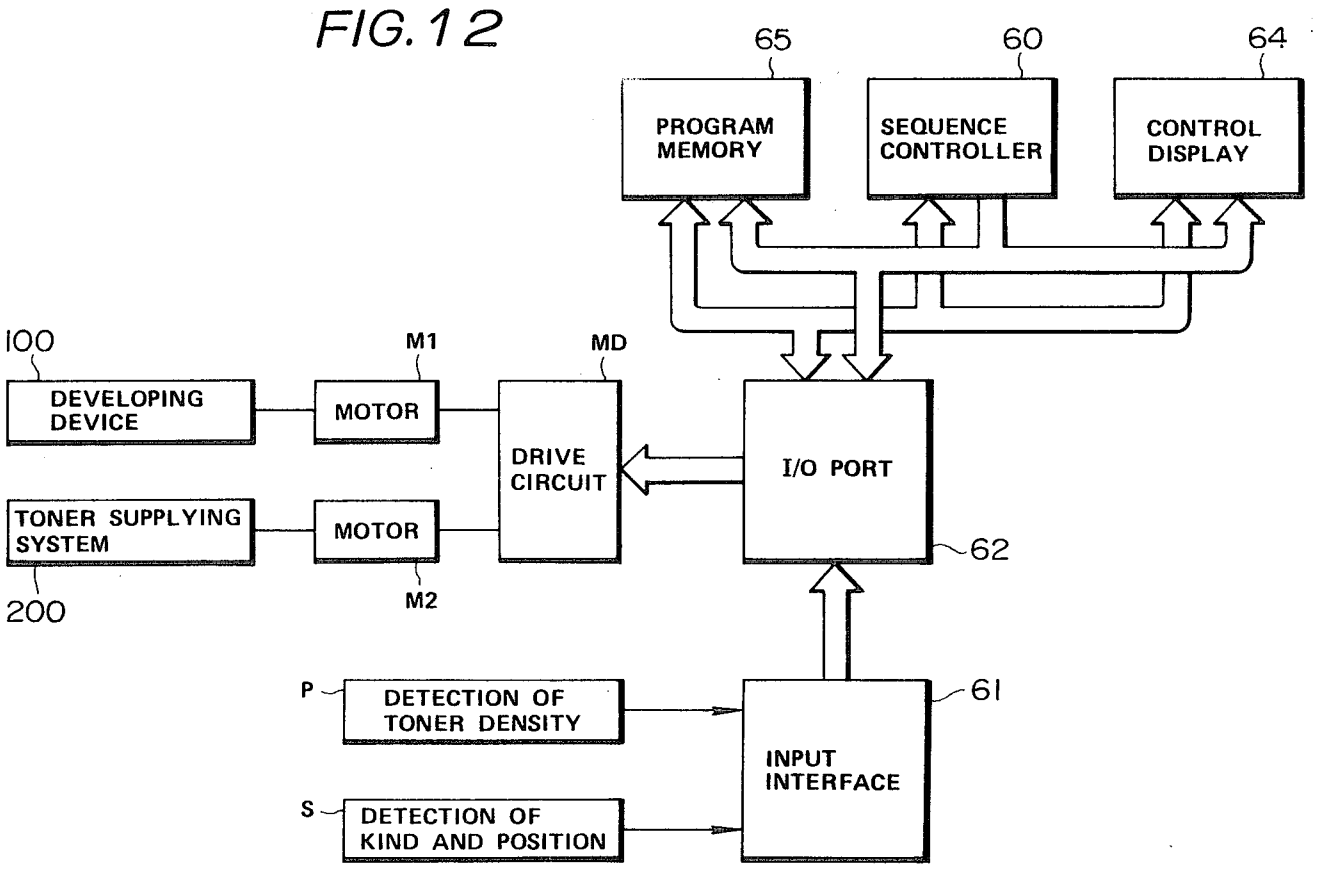
FIG. 12 is a block diagram explaining the operation of the rotary developing device and the toner supplying system of FIG. 1.

FIG. 12 is a block diagram showing the control of the toner supplying system and related parts. The control of the copying machine as a whole is conducted by a sequence controller or a central processing unit (CPU) 60.

It is assumed here that the yellow developing unit 101Y is undergoing a developing operation. In this state, the CPU 60 recognizes, from the signal derived from the color/position detector S, that the yellow developing unit 101Y is in the developing position. If the toner density detector P finds the toner density in this developing unit to be too low, the detector P produces an output signal which is delivered to the CPU 60 through an input interface 61 and an I/O (input/output) port 62. Upon receipt of this signal, the CPU delivers a signal to a program memory 63 to allow the development to continue only on the copy paper which is undergoing a developing operation. After the completion of the copying operation with this copying paper, the motor M1 is driven by the drive circuit MD so that the rotor 300 is rotated such as to bring the developing unit 101Y to the toner supplying position. When the developing unit 101Y has reached the toner supplying position, the detector S produces a signal for stopping the rotor 30, while starting the toner supplying drive motor M2 thereby supplying the yellow toner.

Obviously, the series of toner supplying operations for the yellow developing unit 101Y as described applies equally to each of the other developing units, i.e., the magenta developing unit, the cyane developing unit and the black developing unit.

Although the toner supplying system of the invention may be applied to a developing device which makes use of a bi-component developing agent, this is not its only application; and the toner supplying system of this invention can be applied equally to a developing device which makes use of a mono-component developing agent. In such a case, the timing of the supply of the developing agent is determined through detection of the amount of the developing agent remaining in the developing unit, rather than through detection of a change in density.

Figure 24:
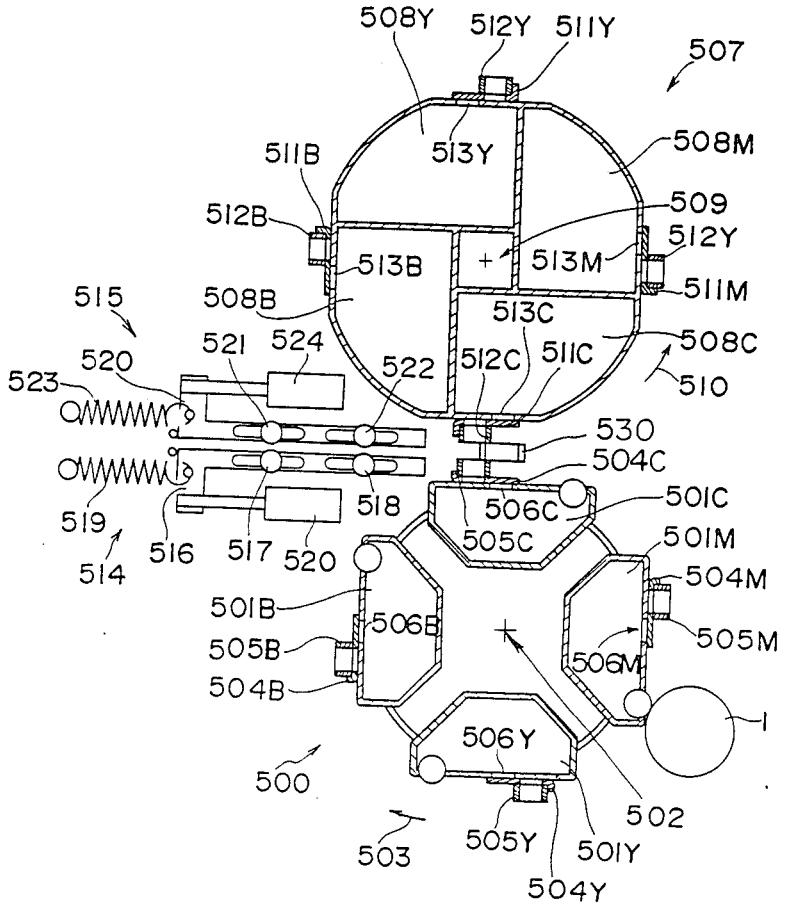
FIG. 24 is a schematic cross-sectional view of a rotary developing device and toner supplying system in accordance with another embodiment of this invention.
Figure 25:
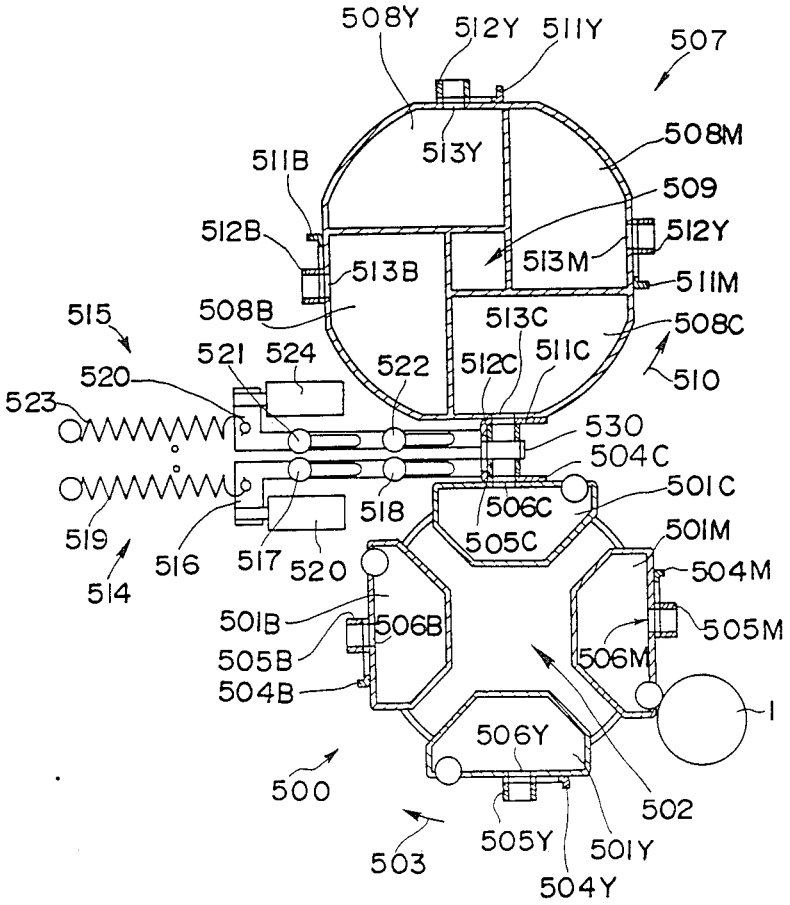
FIG. 25 is a schematic cross-sectional view similar to that in FIG. 24, illustrating the manner in which the toner is supplied by the toner supplying system.

FIGS. 24 and 25 show another embodiment of the toner supplying system in accordance with this invention. In this embodiment, the hopper means and the developing device are designed to rotate together, unlike the embodiment described before.

In this case, the developing device 500 has four developing units 501Y, 501M, 501C and 501B which are adapted to rotate about an axis 502 clockwise as shown by an arrow 503.

The developing units 501 are provided with respective shutters 504Y, 504M, 504C and 504B which are designed to be held in the closing state by spring action which is basically the same as that explained before in connection with FIG. 20, although the guide pins and springs are not shown in FIGS. 24 and 25.

Guideway members 505Y, 505M, 505C and 505B, which are made of an elastic material, for example Moltpren® soft urethane foam, are arranged around the openings of respective shutter plates 504, in order to ensure smooth delivery of the developing agent.

In the position shown in FIG. 24, the openings 506Y, 506M, 506C and 506B of the developing units 501 are all closed by corresponding shutters 504Y, 504M, 504C and 504B.

The hopper means 507 includes hoppers 508Y, 508M, 508C and 508B of four different colors for the four developing units of the developing device, respectively. The hopper means 507 is adapted to rotate about an axis 509 in the direction of the arrow 510.

The hoppers 508 are provided with associated shutters 511Y, 511M, 511C and 511B, as well as guideway members 512Y, 512M, 512C and 512B, similar to the shutters 504 and guideway members 505 of the developing units 501.

In the position shown in FIG. 24, the hopper openings 513Y, 513M, 513C and 513B are all closed. A stationary guideway means 530 is provided between the developing device 500 and the hopper means 507 such as to provide communication between the guideway members 505 in respective developing units 501 and the guideway members 512 of the respective hoppers 508.

The shutters 504 of the developing units 501 and the shutters 511 of the hoppers are adapted to be opened and closed by plunger mechanisms 514 and 515 which are disposed in the vicinity of the stationary guideway means 530.

The plunger mechanism 514 is provided with a slide bar 516 which is arranged to be moved back and forth while being guided by stationary guide pins 517 and 518. The slide bar 516 is urged by a spring 519 to the left, as viewed in FIG. 24, and is adapted to be driven to the right, i.e., towards the shutter 504 of a developing unit 501, by the operation of a solenoid-actuated plunger 520.

The plunger mechanism 515 has the same construction as the above-explained plunger mechanism 514. The plunger mechanism 515 includes a slide bar 520, guide pins 521,522, a spring 523 and a solenoid-actuated plunger 524 arranged symmetrically, about a horizontal line, with their counterparts in the plunger mechanism 514. The plunger mechanism 515 acts on the shutters 511 of the hoppers 508.

In the position shown in FIG. 25, the solenoids of both plungers 520 and 524 are energized so that the slide bars 516 and 520 and, hence, the shutter 504C of the developing unit 501C and the shutter 511C of the hopper 508, are urged to the right, thus allowing the guideway members 505C and 512C to be in communication with each other through the stationary guideway means 530.

Preferably, the energization of the plungers 520 and 524 and the operation of the slide bars 516 and 520 are carried out in the following sequence. The plunger 520 for the developing unit 501C is energized first so that the shutter 504C is opened by the slide bar 516. Then, the solenoid of the plunger 524 for the hopper 508C is energized so that the slide bar 520 moves to open the shutter 511C. After the completion of the supply of the toner, the solenoid of the plunger 524 is de-energized such as to close the shutter 511C; and then the solenoid of the plunger 520 is de-energized such as to close the shutter 504C.

It will be seen that the above-explained sequence of operation enables the supply of the toner from the hopper means to the developing units without allowing external scattering of the toner. That is, since the developing agent is supplied from the hoppers to corresponding developing units by the force of gravity, and since the above-explained sequence ensures that the shutter 504C is opened whenever the shutter 511C is opened, the developing agent can flow into the developing unit 501C without being scattered.

Some of the advantages of the toner supplying system in accordance with the invention are:

(1) Since the toner container is disposed outside the developing device, the container size can be selected freely so that a large quantity of the toner can be stored, thus allowing successive continuous copying cycles for producing a large number of copies.

(2) The manual work which has been heretofore required for the supply of the toner can be significantly reduced.

(3) The developing units themselves need not hold large quantities of toner so that the size of the units and, hence, the radius of rotation of the developing device as a whole are decreased. This in turn facilitates control of the apparatus.

(4) By virtue of the hermetic construction of the toner passage means, it is possible to avoid external scattering of the toner and mixing of toners of different colors which might otherwise be caused during the movement of the developing units or by vibration and impact at the time of start and stop of the developing device.

(5) The risk of the intermediate pipe 350 in the embodiments of FIGS. 1–9 and 13–16 becoming locked or causing an increase in the load for driving the rotor by clogging of toner particles in the toner passage means, is eliminated.

Although the invention has been described through specific terms, it is to be noted that the described embodiments are only illustrative and various changes and modifications may be imparted thereto without departing from the scope of the invention which is limited solely by the appended claims.

We claim:

1. In combination, a developing device of the type in which a developing unit conveyor carries a plurality of developing units along a continuous path so that each developing unit is successively brought to a developing position for the development of a latent image on an image carrying member, and a toner supplying system, said toner supplying system comprising hopper means disposed externally of said developing unit conveyor and toner conveyor means extending from said hopper means to a predetermined filling position of each of said developing units along said continuous path.

2. A combination according to claim 1 wherein said toner conveyor means comprises a plurality of toner conveyors and associated passageway means, each toner conveyor extending from said hopper means to an associated one of said passageway means, each passageway means being formed with a toner supplying port positioned at a predetermined filling position of an associated developing unit so as to come into communication with a toner inlet port in said associated developing unit at its said predetermined filling position.

3. A combination according to claim 2 wherein the predetermined filling position of each developing unit along said continuous path is under its associated passageway means toner supplying port so that toner passes through said toner supplying port and into said developing unit by force of gravity.

4. A combination according to claim 3 wherein said toner supplying ports are arranged in a line which extends across the continuous path of movement of the developing units and wherein said developing units are successively brought to the same predetermined filling position.

5. A combination according to claim 2 wherein each developing unit includes a developing unit shutter plate mounted and arranged to maintain its respective toner inlet port closed during movement of said developing unit around said continuous path and to open said respective toner inlet port when the developing unit is in its said predetermined filling position.

6. A combination according to claim 4 wherein sealing partitions are arranged to extend between each passageway means and its associated developing unit to prevent scattering of toner passing from each passageway means to its respective developing unit.

7. A combination according to claim 5 wherein each developing unit shutter plate is formed with an opening, said shutter plate being mounted for sliding movement on said developing unit between a first position closing the toner inlet port of said developing unit and a second position opening said toner inlet port, means resiliently biasing said shutter plate to said first position, and an engaging member positioned to be engaged by an element in said developing device as said developing unit moves to its predetermined filling position to shift said shutter plate to its second position.

8. A combination according to claim 7 wherein said shutter plate is formed with slots extending in the direction of movement between said first and second positions, wherein pins extend through said slots and are attached to said developing unit and wherein a spring extends between one of said pins and another pin on said shutter plate to hold said shutter plate in its said first position.

9. A combination according to claim 2 wherein each passageway means includes a passageway means shield plate mounted and arranged to cover the toner supplying port of its respective passageway means during movement of its associated developing unit around said continuous path and to uncover and open said toner supplying port when said associated developing unit is in said predetermined filling position.

10. A combination according to claim 9 wherein each passageway means shield plate is formed with an opening and mounted for sliding movement on said passageway means between a first position covering said toner supplying port to stop the flow of toner therefrom and a second position uncovering and opening said toner supplying port to allow the flow of toner therefrom, means resiliently biasing said plate to said first position, and a pin mounted to move with said conveyor and to engage said plate and move it to said second position when an associated developer unit moves to said predetermined filling position.

11. A combination according to claim 10 wherein said passageway means shield plate is formed with slots extending in the direction of movement between said first and second positions, wherein pins extend through said slots and are attached to said passageway means and wherein a spring extends between one of said pins and another pin on said shield to hold said shield in its said first position.

12. A combination according to claim 2 wherein said developing unit conveyor is a rotary conveyor, wherein said developing units are mounted at different rotational positions about said rotary conveyor, wherein said rotary conveyor is mounted to rotate about a hollow shaft and wherein said passageway means are arranged inside said shaft and said toner supplying ports are formed to extend out through the wall of said hollow shaft at different axial locations therealong.

13. A combination according to claim 12 wherein said toner conveyors comprise pipes which extend from said hopper means to respective passageway means inside said hollow shaft.

14. A combination according to claim 13 wherein said pipes extend into said hollow shaft from one end thereof.

15. A combination according to claim 12 wherein the toner supplying ports of said passageway means each extend out through the wall of said hollow shaft and open downwardly at axially displaced locations therealong.

16. A combination according to claim 15 wherein said rotary conveyor includes an intermediate pipe which surrounds said hollow shaft and which rotates thereabout together with said developing units, said intermediate pipe and said hollow shaft forming an annular chamber therebetween, the toner inlet ports of said developing units being in communication with the interior of said intermediate pipe through associated openings in the wall thereof, said associated openings being displaced from each other both rotationally about and axially along said intermediate pipe.

17. A combination according to claim 16 wherein said axially displaced locations are axially aligned with the respective associated openings in the wall of said intermediate pipe.

18. A combination according to claim 17 wherein sealing partitions are positioned in said annular chamber to divide same into axially separated sub-chambers, each sub-chamber containing one of said toner supplying ports and also containing an opening to one of said developing unit ports.

19. A combination according to claim 5 wherein said developing unit shutter plates are pivotally mounted.

20. A combination according to claim 19 wherein said predetermined filling position is under said passageway means and wherein said developing unit shutter plates are pivotally mounted so that they swing open by force of gravity when their respective developing units are in said filling position and so that they remain tight against a ledge to hold their respective toner inlet ports closed when their respective developing units are away from said filling position.

21. A combination according to claim 5 wherein said developing unit shutter plates are resiliently biased to a condition closing their respective toner inlet ports and wherein cams are provided at fixed locations on said developing device to be engaged by followers on said shutters, said cams and cam followers being arranged to cause each shutter to become opened when its respective developing unit reaches its said predetermined filling position.

22. A combination according to claim 18 wherein said sealing partitions each comprise a first sealing element extending around the outside of and fixed on said hollow shaft so as not to rotate and a second sealing element extending around the inside of and fixed to said intermediate pipe to rotate therewith, said first and second sealing elements being in sliding sealing contact therewith.

23. A combination according to claim 22 wherein said sealing elements have mutually facing flange-like surfaces and means resiliently holding said flange-like surfaces in sliding sealing contact.

24. A combination according to claim 23 wherein at least one of said sealing elements in mounted for limited axial movement and wherein a spring is mounted in said annular chamber to hold said one sealing element against the other sealing element.

25. A combination according to claim 22 wherein said sealing elements are in axial alignment, wherein one of said elements is axially wider than the other, wherein annularly shaped pressure contact members are arranged on opposite sides of said one element and wherein springs are arranged inside said annular chamber to force said annularly shaped pressure contact members toward each other.

26. A combination according to claim 18 wherein said intermediate pipe is made up of axially separated segments which contact each other at and are supported by said sealing partitions.

27. A combination according to claim 26 wherein said sealing partitions comprise support rings arranged at the junctions of said intermediate pipe segments and which extend toward said hollow shaft and elastic sealing members attached to said hollow shaft and pressed against the opposite sides of said support rings.

28. A combination according to claim 2 wherein each developing unit includes a developing unit shutter and each passageway means includes a a toner supply port and a passageway shield, each said shutter being moveable between toner inlet port opening and closing positions and each said shield being moveable between toner supply port opening and closing positions on said passageway means, means biasing said shutters and shields to their respective closing positions and shutter and shield actuation means arranged to move each shutter and associated shield to its respective opening position when its respective developer unit is in its predetermined filling position.

29. A combination according to claim 28 wherein said shutter and shield actuation means is constructed to cause said shutter to move to its open position before said shield is moved to its open position and to allow said shield to move to its closed position before said shutter is moved to its closed position.

30. A combination according to claim 28 wherein said means arranged to move each shutter and shield to its respective opening position comprises plunger means moveable in the direction of movement of said shutter and shield to engage and move said shutter and shield when their associated developer unit is in its said predetermined filling position.

31. A combination according to claim 13 wherein screw conveyors are provided inside the pipes which extend from said hopper means to respective passageway means inside said hollow shaft.

32. A combination according to claim 1 wherein said hopper means comprises a plurality of hoppers mounted on a hopper conveyor for successive movement to a position immediately above an associated developing unit when said developer unit is at its predetermined filling position.

33. A combination according to claim 32 wherein said developing unit conveyor and said hopper conveyor are rotary conveyors and wherein said hopper conveyor is mounted above said developing unit conveyor.

34. A combination according to claim 1 wherein said hopper means comprise a plurality of hoppers for receiving toners of different colors, respectively, and a predetermined amount of toner is supplied from each hopper to a respective developing unit.

35. In combination, a developing device of the type in which a conveyor carries a plurality of developing units around a circular path so that each developing unit is successively brought brought to a developing position for the development of latent image on an image carrying member and a toner supplying system, said toner supplying system comprising a hollow shaft extending along the axis of the circular path of the developer units, toner conveyor means arranged to supply toner into the interior of said hollow shaft from hopper means disposed externally of said developing device and passage means extending out through the side of said shaft from the interior thereof to said developing units.

36. A combination according to claim 35 wherein said toner conveyor means comprises a plurality of pipes extending from external hopper means to respective passage means inside the hollow shaft, screw impellers extending along the interior of said toner conveyor means and electric motor means completed to drive said screw impellers.

37. A combination according to claim 35 wherein said hopper means comprise a plurality of hoppers for receiving toners of different colors, respectively, and a predetermined amount of toner is supplied from each hopper to a respective developing unit.

38. A combination according to claim 36 wherein a plurality of passage means are axially displaced along said hollow shaft and open from said hollow shaft toward associated developing units.

39. A combination according to claim 38 wherein an intermediate pipe surrounds said hollow shaft and rotates with said conveyor means, said intermediate pipe being formed with openings leading to associated ones of said developing units, said openings being axially aligned with said passage means and being rotationally displaced from each other around said intermediate pipe.

40. A combination according to claim 39 wherein partition means extend between said hollow shaft and said intermediate pipe to form a plurality of axially displaced sub-chambers therebetween, each sub-chamber being arranged to communicate with an associated passage means and an associated developing unit.

41. A combination according to claim 40 wherein each developing unit is provided with a toner inlet port in communication with said opening in said annular chamber and a shutter arranged to close said port until said developing unit is moved to a predetermined filling position.

42. A combination according to claim 35 wherein moveable shutters are mounted on said hollow shaft in a manner to permit opening and closing of toner supply ports in said passage means, each shutter being arranged to become opened when a developing unit associated with its respective passage means comes to a predetermined filling position.

43. A combination according to claim 35 further comprising means for detecting the toner density in each developing unit as the unit comes into a developing position, and means for causing a developing unit to be brought to a filling position and refilled with toner in response to the detection of a low toner density.

44. A toner supplying system for use in combination with a developing device of the type having a conveyor means carrying a plurality of developing units such as to bring each developing unit to a developing position for the development of a latent image on an image carrying member, said toner supplying system comprising a hopper means disposed outside said developing device, a toner transportation means for transporting said toner from said hopper means into a shaft provided in said conveyor means, and a toner passage means through which said toner is supplied from said shaft to respective developing units.

45. A toner supplying system according to claim 44 wherein said hopper means comprise a plurality of hoppers for receiving toners of different colors, respectively, and a predetermined amount of toner is supplied from each hopper to a respective developing unit.

46. A toner supplying system according to claim 44, wherein said toner transportation means includes a pipe connected between said hopper means and said toner passage means in said shaft, a screw disposed in said pipe, and an electric motor coupled to drive said screw.

47. A toner supplying system according to claim 44, wherein said conveyor means includes a rotor supported rotatably by said shaft.

48. A toner supplying system according to claim 44, wherein said toner passage means is arranged to allow said toner to fall into said developing unit by the force of gravity when said developing unit has been brought to a toner supplying position.

49. A toner supplying system according to claim 48, wherein said toner supplying position is in the lower portion of said rotor.

50. A toner supplying system according to claim 46, wherein said toner passage means is arranged to allow said toner to fall into said developing unit by the force of gravity when said developing unit has been brought to a toner supplying position.

51. A toner supplying system according to claim 50, wherein said toner supplying position is in the lower portion of said rotor.

52. A toner supplying system according to claim 44, further comprising means for detecting the toner density in said developing unit and, in response to the detection of a predetermine level of toner density, to produce a signal for bringing said developing unit to said toner supplying position.

53. A toner supplying system according to claim 52, wherein said means for detecting the toner density is positioned and arranged to detect the toner density in the developing unit which is under the developing operation.

54. A toner supplying system for use in combination with a developing device of the type having a conveyor means carrying a plurality of developing units such as to bring each developing unit to a developing position for the development of a latent image on an image carrying member, said toner supplying system comprising toner passage means for supplying toners to respective developing units from hopper means disposed externally of said developing device, said toner passage means including a shaft extending through said conveyor means and an annular chamber surrounding said shaft.

55. A toner supplying system according to claim 54 wherein said hopper means comprise a plurality of hoppers for receiving toners of different colors, respectively, and a predetermined amount of toner is supplied from each hopper to a respective developing unit.

56. A toner supplying system according to claim 54, wherein said conveyor means comprises a rotor mounted for rotation about said shaft.

57. A toner supplying system according to claim 56, wherein said annular chamber is defined by an intermediate pipe surrounding said shaft and rotatable together with said conveyor means.

58. A toner supplying system according to claim 57, wherein said intermediate pipe is composed of a plurality of pipe segments.

59. A toner supplying system according to claim 54 wherein said annular chamber is sectioned by partitioning sealing means into a plurality of annular sub-chambers arranged in the axial direction of said shaft, said shaft including supply ports in communication with said annular sub-chambers.

60. A toner supplying system according to claim 59, wherein said partitioning sealing means includes a pair of axially slidable partition members and spring means for urging said partition members towards each other such as to keep them in sealing contact with each other.

61. A toner supplying system according to claim 59, wherein said partitioning sealing means includes a first partition member fixed to said shaft, a second partition member fixed to a wall concentric with said shaft, said second partition member being held in sliding contact with the inner peripheral surface of said first partition member such as to be able to move relatively to said first partition member, pressure contact members contacting both side surfaces of at least one of said first and second partition members, and spring means for urging slide pressure contact members into contact with said partition members.

62. A toner supplying system according to claim 59, wherein said partitioning sealing means includes an elastic ring secured to a concentric wall and making a resilient contact with the outer peripheral surface of said shaft such as to be able to move relatively to said shaft.

63. A toner supplying system for use in combination with a developing device of the type having a conveyor means carrying a plurality of developing units such as to bring each developing unit to a developing position for the development of a latent image on an image carrying member and to bring each developing unit to a toner supplying position for receiving a supply of toner, said toner supplying system comprising hopper means disposed externally of said developing device, and toner passage means connecting said hopper means to said developing device, said toner passage means being switchable between open and closed states and arranged to be switched to said open state only when one of developing units of said developing device is in a toner supplying position.

64. A toner supplying system according to claim 63 wherein said hopper means comprise a plurality of hoppers for receiving toners of different colors, respectively, and a predetermined amount of toner is supplied from each hopper to a respective developing unit.

65. A toner supplying system according to claim 63, wherein said toner passage means includes toner receiving ports formed in said developing units and shutter plates mounted and arranged to open and close said toner receiving ports, said shutter plates being swingable about respective pivot axes by the force of gravity.

66. A toner supplying system according to claim 63, wherein said toner passage means includes shielding means slidably attached to a hollow shaft to open and close toner supplying ports formed in said hollow shaft, said hollow shaft being connected to a toner transporting means, said shielding means being biased to close said toner supplying ports, shutter means slidably attached to said developing units, said developing units being formed with toner receiving ports, and shutter means slidably attached to said developing units to open and close said toner receiving ports, said shutter means being biased to close said toner receiving ports, said shutter means being positioned and arranged to engage said shielding means when the associated developing unit is being moved to a toner supplying position such that said shutter means and said shielding means are moved together, thereby opening said toner receiving port and said toner supplying port.

67. A toner supplying system according to claim 65 wherein said conveyor means includes a rotor and said hollow shaft constitutes a shaft for rotatably supporting said rotor.

68. A toner supplying system according to claim 66 wherein said conveyor means includes a rotor and said hollow shaft constitutes a shaft for rotatably supporting said rotor.

69. A toner supplying system according to claim 63, wherein said hopper means are supported rotatably in such a manner as to correspond to said developing device, said toner passage means including toner supplying ports formed in respective hoppers of said hopper means, shutter means slidably attached to respective hoppers such as to open and close said toner supplying ports, said shutter means being biased to close said supplying ports, toner receiving ports formed in respective developing units of said developing device, shutter means slidably attached to respective developing units such as to open and close said toner receiving ports, said shutter means being biased to close said toner receiving ports, and plunger means for operating said shutter means for said hoppers and said shutter means for said developing units, whereby, when a developing unit and its associated hopper are moved to a toner supplying position, both shutter means are operated by said plunger means to open both said toner supplying port and said toner receiving port.

* * * * *